US010514628B2

(12) United States Patent
Shiomi et al.

(10) Patent No.: US 10,514,628 B2
(45) Date of Patent: Dec. 24, 2019

(54) DEVELOPING DEVICE INCLUDING A RESIN-MADE REGULATING BLADE

(71) Applicant: CANON KABUSHIKI KAISHA, Tokyo (JP)

(72) Inventors: Tomohiro Shiomi, Abiko (JP); Teruaki Tsurusaki, Moriya (JP); Shunichi Koga, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/113,371

(22) Filed: Aug. 27, 2018

(65) Prior Publication Data

US 2019/0072875 A1 Mar. 7, 2019

(30) Foreign Application Priority Data

Sep. 7, 2017 (JP) ..... 2017-172338
Aug. 3, 2018 (JP) ..... 2018-146713

(51) Int. Cl.
*G03G 15/08* (2006.01)
*G03G 15/09* (2006.01)
*G03G 21/16* (2006.01)

(52) U.S. Cl.
CPC ..... *G03G 15/0812* (2013.01); *G03G 21/1676* (2013.01); *G03G 2221/1654* (2013.01)

(58) Field of Classification Search
CPC ..... G03G 15/0812
USPC ..... 399/274, 284
See application file for complete search history.

(56) References Cited

U.S. PATENT DOCUMENTS 8,737,889 B2 * 5/2014 Mori ..... G03G 15/0812 399/284
8,781,377 B2 * 7/2014 Shiraki et al. ..... G03G 15/0812 399/284
8,831,487 B2 9/2014 Kashiide et al.
9,239,539 B2 1/2016 Yasumoto et al.

FOREIGN PATENT DOCUMENTS

JP H05-257383 A 10/1993
JP 2009-204703 A 9/2009
JP 2015-34929 A 2/2015

OTHER PUBLICATIONS

European Search Report dated Jan. 24, 2019, in related European Patent Application No. 18189297.7.

* cited by examiner

*Primary Examiner* — William J Royer
(74) *Attorney, Agent, or Firm* — Venable LLP

(57) ABSTRACT

A developing device includes a rotatable developing member, a resin-made regulating blade, and a resin-made developing device frame including at least a mounting portion. The regulating blade is fixed, in a state that the regulating blade is flexed, in a region of the mounting portion corresponding to a maximum image region of an image bearing member so that a gap between the rotatable developing member and the regulating blade falls within a predetermined range over a rotational axis direction of the rotatable developing member. The mounting portion is provided with a rib which includes a portion projecting from the mounting portion and extending along a direction parallel to the rotational axis direction of the rotatable developing member and which is formed over an entirety of a region of the mounting portion corresponding to the maximum image region of the image bearing member.

20 Claims, 16 Drawing Sheets

DEVELOPING DEVICE INCLUDING A RESIN-MADE REGULATING BLADE

FIELD OF THE INVENTION AND RELATED ART

The present invention relates to a developing device including a resin-made regulating blade.

The developing device includes a developing device frame, a rotatable developer carrying member for carrying a developer in order to develop an electrostatic latent image formed on an image bearing member, and a regulating blade as a developer regulating member for regulating an amount of the developer carried on the developer carrying member. The regulating blade is provided opposed to the developer carrying member with a predetermined gap between itself and the developer carrying member over a direction parallel to a rotational axis of the developer carrying member (hereinafter, the gap is referred to as an SB gap). The SB gap refers to a minimum distance between the developer carrying member and the regulating blade. By adjusting a magnitude of this SB gap, an amount of the developer fed to a developing region where the developer carrying member opposes an image bearing member is adjusted.

Japanese Laid-Open Patent Application (JP-A) 2015-34929 discloses a developing device including a resin-made developer regulating member prepared by molding a resin material and a resin-made developing device frame prepared by molding a resin material.

During an image forming operation, with respect to the direction parallel to the rotational axis of the developer carrying member, a developer pressure generating from a flow of a developer is exerted on a regulating blade in a region (maximum image region of a regulating blade) corresponding to a maximum image region of an image region in which an image is formed on an image bearing member. With lower rigidity of the regulating blade in the maximum image region, the regulating blade is liable to deform in the maximum image region when the developer pressure is exerted on the regulating blade in the maximum image region, and thus a degree of a fluctuation in magnitude of the SB gap during the image forming operation becomes larger. In order to suppress the fluctuation in magnitude of the SB gap during the image forming operation, there is a need to enhance the rigidity of the regulating blade in the maximum image region.

In JP-A 2015-34929, in order to enhance the rigidity of the resin-made developer regulating member, ribs are provided in the maximum image region of the resin-made developer regulating member, whereby geometrical moment of inertia in cross-section perpendicular to the resin-made developer regulating member is increased.

In general, geometrical moment of inertia in cross-section perpendicular to the developing device frame is larger than geometrical moment of inertia in cross-section perpendicular to the regulating blade, and therefore, in a state that the regulating blade is fixed to the developing device frame, compared with rigidity of the regulating blade, rigidity of the developing device frame is dominant. For that reason, the rigidity of the regulating blade in the state that the regulating blade is fixed to the developing device frame is higher than rigidity of the regulating blade in a state that the regulating blade is not fixed to the developing device frame. Therefore, in the developing device in which the resin-made regulating blade low in rigidity is fixed to the resin-made developing device frame, it is required that rigidity of a portion (blade mounting portion of the developing device frame), of the developing device frame, where the regulating blade is fixed to the developing device frame is increased and thus the rigidity of the regulating blade in the state that the regulating blade is fixed to the developing device frame is enhanced.

In order to increase (enhance) the rigidity of the blade mounting portion of the developing device frame, it would be considered that a thickness of the blade mounting portion of the developing device frame is increased. However, in general, as regards a resin mold product larger in (magnitude of) thickness than a predetermined value, compared with a resin mold product having a thickness of not more than the predetermined value, when a resin material thermal expanded during molding is thermally contracted, a degree of generation of a difference in progress of thermal contraction between an inside and an outside of the resin mold product is liable to become large. For that reason, the resin mold product having the thickness larger than the predetermined value has a tendency that sink marks are liable to generate compared with the resin mold product having the thickness of not more than the predetermined value. Further, as regards the resin mold product, a cooling time and a cycle time during the molding become longer with an increasing thickness, and therefore the increase of the thickness is disadvantageous in terms of mass-productivity. For that reason, for the purpose of enhancing the rigidity of the blade mounting portion of the developing device frame, there is a limit to a degree of the increase of the thickness of the blade mounting portion of the developing device frame. Therefore, as regards the developing device frame having the thickness of nor not more than the predetermined value, in order to enhance the rigidity of the blade mounting portion of the developing device frame, it would be considered that the blade mounting portion of the developing device frame is provided with ribs.

SUMMARY OF THE INVENTION

A principal object of the present invention is to provide a developing device capable of suppressing a fluctuation in magnitude of an SB gap due to thermal stress from ribs provided at a portion (mounting portion) where a resin-made regulating blade low in rigidity is fixed to a resin-made developing device frame, in a state that the resin-made regulating blade is fixed to the resin-made developing device frame.

An aspect of the present invention is to provide a developing device comprising: a rotatable developing member configured to carry and feed a developer comprising toner and a carrier toward a position where an electrostatic image formed on an image bearing member is developed; a resin-made regulating blade provided opposed to the rotatable developing member in non-contact with the rotatable developing member and configured to regulate an amount of the developer carried on the rotatable developing member; and a resin-made developing device frame including at least a mounting portion configured to mount the regulating blade, the mounting portion being provided in a maximum image region, with respect to a rotational axis direction of the rotatable developing member, of an image region of the image bearing member in which an image is formable on the image bearing member, wherein the regulating blade is fixed, in a state that the regulating blade is flexed, in a region of the mounting portion corresponding to the maximum image region of the image bearing member so that a gap between the rotatable developing member supported by the developing device frame and the regulating blade mounted on the mounting portion falls within a predetermined range over the rotational axis direction of the rotatable developing member, and wherein the mounting portion is provided with a rib which includes a portion projecting from the mounting portion and extending along a direction parallel to the rotational axis direction of the rotatable developing member and which is formed over an entirety of the region of the mounting portion corresponding to the maximum image region of the image bearing member.

Further features of the present invention will become apparent from the following description of exemplary embodiments with reference to the attached drawings.

DESCRIPTION OF EMBODIMENTS

Embodiments of the invention will be specifically described with reference to the drawings. Incidentally, the following embodiments do not limit the present invention according to the claims, and all combinations of features described in a First Embodiment are not necessarily essential to means for solving a problem of the present invention. The present invention can be carried out in various uses such as printers, various printing machines, facsimile machines and multi-function machines.

First Embodiment (Structure of Image Forming Apparatus)

Figure 1:
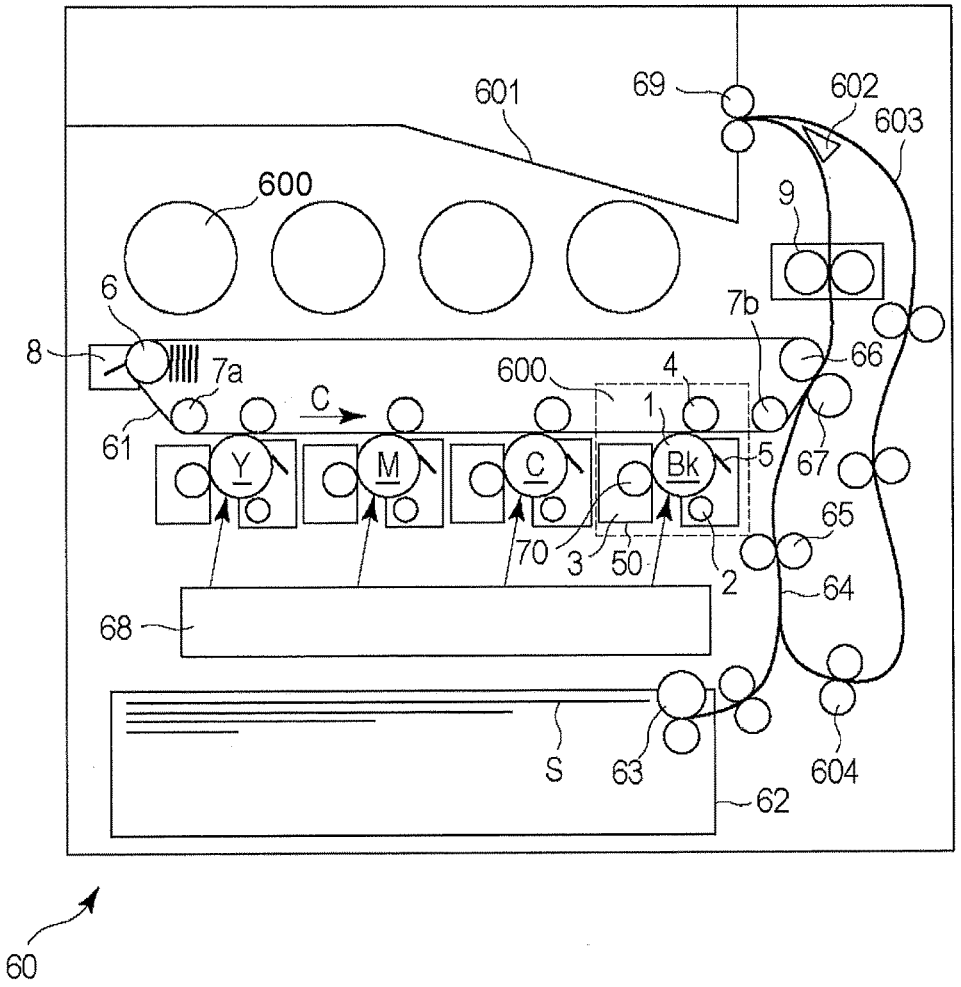
FIG. 1 is a sectional view showing a structure of an image forming apparatus.

First, a structure (constitution) of an image forming apparatus according to the First Embodiment of the present invention will be described with reference to a sectional view of FIG. 1. As shown in FIG. 1, an image forming apparatus 60 includes an endless intermediary transfer belt (ITB) 61 as an intermediary transfer member and four image forming portions 600 provided from an upstream side toward a downstream side along a rotational direction (arrow C direction of FIG. 1) of the intermediary transfer belt 61. The image forming portions 600 form toner images of colors of yellow (Y), magenta (M), cyan (C) and black (Bk), respectively.

The image forming portion 600 includes a rotatable photosensitive drum 1 as an image bearing member. Further, the image forming portion 600 includes a charging roller 2 as a charging means, a developing device 3 as a developing means, a primary transfer roller 4 as a primary transfer means and a photosensitive member cleaner 5 as a photosensitive member cleaning means, which are provided along a rotational direction of the photosensitive drum 1.

Each of the developing devices 3 is detachably mountable to the image forming apparatus 60. Each of the developing devices 3 includes a developing container 50 which accommodates a two-component developer (hereinafter, simply referred to as a developer) containing non-magnetic toner (hereinafter, simply referred to as toner) and a magnetic carrier. Further, each of toner cartridges, containing toners of the colors of Y, M, C and Bk, is detachably mountable to the image forming apparatus 60. The toners of the respective colors of Y, M, C and Bk pass through toner feeding paths and are supplied to the developing containers 50, respectively. Incidentally, details of each developing device 3 will be described later with reference to FIGS. 2 to 4, and details of each developing container 50 will be described later with reference to FIG. 5.

The intermediary transfer belt 61 is stretched by a tension roller 6, a follower roller 7*a*, the primary transfer roller 4, a follower roller 7*b* and an inner secondary transfer roller 66, and is fed and driven in the arrow C direction of FIG. 1. The inner secondary transfer roller 66 also functions as a driving roller for driving the intermediary transfer belt 61. With rotation of the inner secondary transfer roller 66, the intermediary transfer belt 61 is rotated in the arrow C direction of FIG. 1.

The intermediary transfer belt 61 is pressed from a back-surface side of the intermediary transfer belt 61 by the primary transfer rollers 4. Further, the intermediary transfer belt 61 is contacted to the photosensitive drums 1, so that a primary transfer nip as a primary transfer portion is formed between each of the photosensitive drums 1 and the intermediary transfer belt 61.

At a position opposing the tension roller 6 through the intermediary transfer belt 61, an intermediary transfer member cleaner 8 as a belt cleaning means is contacted to the intermediary transfer belt 61. Further, at a position opposing the inner secondary transfer roller 66 through the intermediary transfer belt 61, an outer secondary transfer roller 67 as a secondary transfer means is provided. The intermediary transfer belt 61 is sandwiched between the inner secondary transfer roller 66 and the outer secondary transfer roller 67. As a result, a secondary transfer nip as a secondary transfer portion is formed between the outer secondary transfer roller 67 and the intermediary transfer belt 61. At the secondary transfer nip, the toner image is attracted to a surface of a sheet S (for example, paper, a film or the like) by applying a predetermined pressing force (pressure) and a transfer bias (electrostatic load bias).

The sheets S are accommodated in a stacked state in a sheet accommodating portion 62 (for example, a feeding cassette, a feeding deck or the like). A feeding means 63 feeds the sheet S in synchronism with image forming timing by using, for example, a friction separation type or the like with a feeding roller or the like. The sheet S fed by the feeding means 63 is fed to a registration roller pair 65 provided at an intermediary position of a feeding path 64. After oblique movement correction and timing correction are carried out by the registration roller pair 65, the sheet S is fed to the secondary transfer nip. In the secondary transfer nip, timing when the sheet S reaches the secondary transfer nip and timing when the toner image reaches the secondary transfer nip coincide with each other, and thus secondary transfer is carried out.

Downstream of the secondary transfer nip with respect to a feeding direction of the sheet S, a fixing device 9 is provided. To the sheet S fed to the fixing device 9, predetermined pressure and predetermined heat quantity are applied from the fixing device 9, so that the toner image is melt-fixed on a surface of the sheet S. The sheet S on which the image is fixed in the above-described manner is discharged onto a discharge tray 601 as it is by normal rotation of a discharging roller pair 69.

In the case where double-side image formation is carried out, after the sheet S is fed by the normal rotation of the discharging roller pair 69 until a trailing end thereof passes through a flapper 602, the discharging roller pair 69 is reversely rotated. As a result, leading and trailing ends of the sheet S are replaced with each other, and the sheet S is fed to a feeding path 603 for the double-side image formation. Thereafter, the sheet S is fed to the feeding path 64 by a re-feeding roller pair 604 in synchronism with subsequent image forming timing.

(Image Forming Process)

During image formation, the photosensitive drum 1 is rotationally driven by a motor. The charging roller 2 charges the surface of the rotationally driven photosensitive drum 1 uniformly in advance. An exposure device 68 forms an electrostatic latent image on the surface of the photosensitive drum 1 charged by the charging roller 2, on the basis of a signal of image information inputted to the image forming apparatus 60. The photosensitive drum 1 is capable of permitting formation of electrostatic latent images of a plurality of sizes.

The developing device 3 includes a rotatable developing sleeve 70 as a developer carrying member for carrying the developer. The developing device 3 develops the electrostatic latent image, formed on the surface of the photosensitive drum 1, with the developer carried on the surface of the developing sleeve 70. As a result, the toner is deposited on an exposed portion on the surface of the photosensitive drum 1, so that the electrostatic latent image is visualized as a visible image (toner image). To the primary transfer roller 4, a transfer bias (electrostatic load bias) is applied, so that the toner image formed on the surface of the photosensitive drum 1 is transferred onto the intermediary transfer belt 61. Toner (transfer residual toner) remaining in a slight amount on the surface of the photosensitive drum 1 after the primary transfer is collected by the photosensitive member cleaner 5, and prepares for a subsequent image forming process.

The image forming processes, for the respective colors, which are performed in parallel by the image forming portions 600 for the respective colors of Y, M, C and Bk are carried out at timings when an associated toner image is successively transferred superposedly onto the toner image for the color on an upstream image forming portion side. As a result, a full-color toner image is formed on the intermediary transfer belt 61, so that the toner image is fed to the secondary transfer nip. To the outer secondary transfer roller 67, a transfer bias is applied, so that the toner image formed on the intermediary transfer belt 61 is transferred onto the sheet S fed to the secondary transfer nip. Toner (transfer residual toner) slightly remaining on the intermediary transfer belt 61 after the sheet S passed through the secondary transfer nip is collected by the intermediary transfer member cleaner 8. The fixing device 9 fixes the toner image transferred on the sheet. The sheet (recording material) S on which the toner image is fixed is discharged onto a discharge tray 601.

A series of image forming processes as described above is ended and then the image forming apparatus 60 prepares for a subsequent image forming operation.

(Structure of Developing Device)

Figure 3:
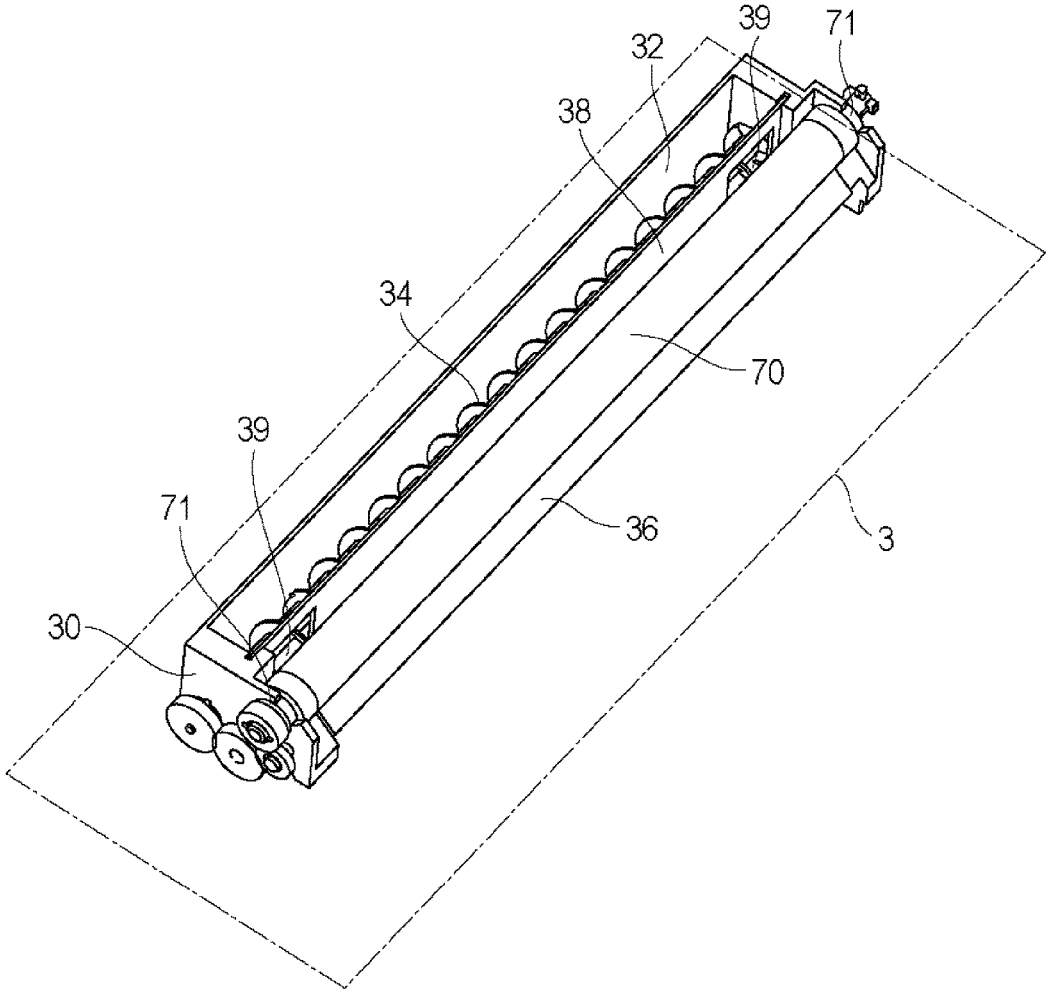
FIG. 3 is a perspective view showing a structure of the developing device.
Figure 4:
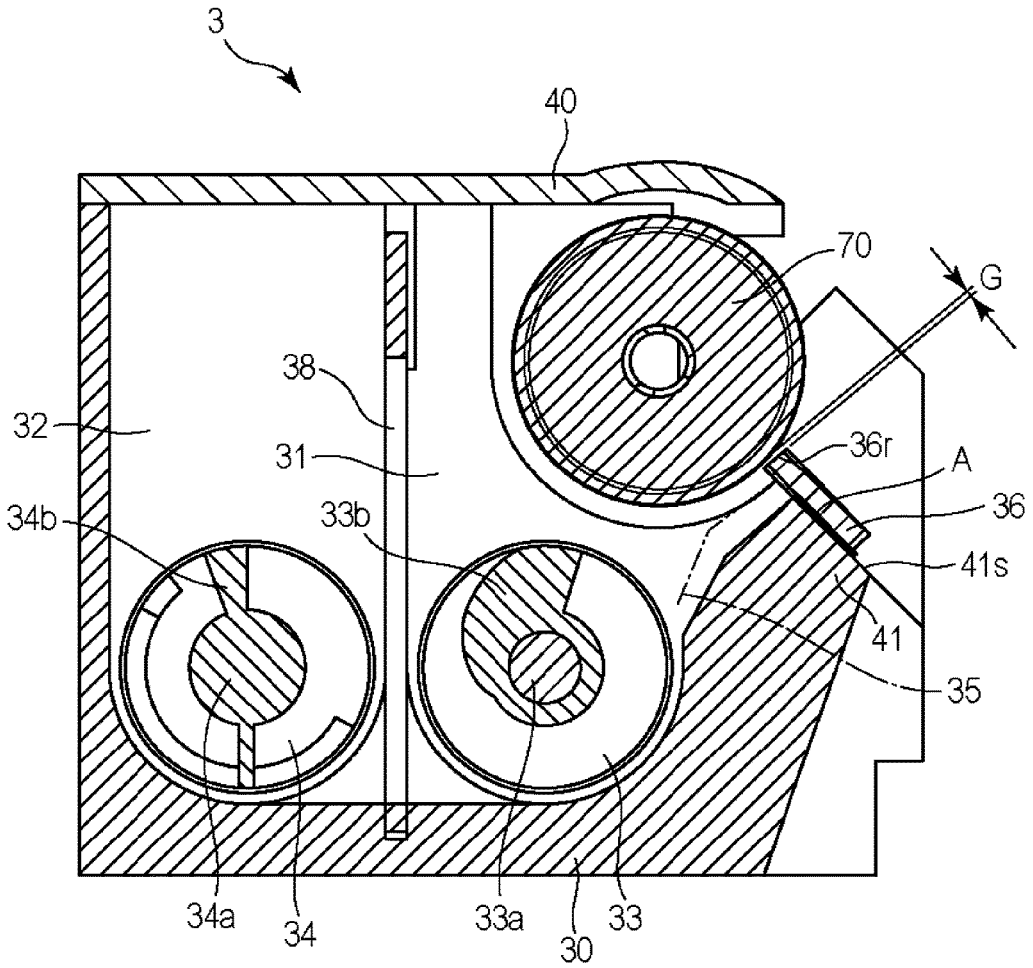
FIG. 4 is a sectional view showing a structure of the developing device.

A general structure of the developing device 3 will be described with reference to perspective views of FIGS. 2 and 3 and a sectional view of FIG. 4, FIG. 4 is the sectional view of the developing device 3 at a cross-section H of FIG. 2.

The developing device 3 includes a resin-made developing device frame 30 molded with a resin material and the developing container 50 which is formed separately from the developing device frame 30 and which is constituted by a resin-made cover frame 40 molded with a resin material. FIG. 2 and FIG. 4 show a state in which the cover frame 40 is mounted on the developing device frame 30, and FIG. 3 shows a state in which the cover frame 40 is not mounted on the developing device frame 30. Incidentally, details of the developing device frame 30 (alone) will be described later with reference to FIG. 6.

The developing container 50 is provided with an opening at a position corresponding to the developing region where the developing sleeve 70 opposes the photosensitive drum 1. At the opening of the developing container 50, the developing sleeve 70 is disposed rotatably relative to the developing container 50 so that a part of the developing sleeve 70 exposes. At each of end portions of the developing sleeve 70, a bearing 71 as a bearing member is provided.

An inside of the developing container 50 is partitioned (sectioned) into a developing chamber 31 as a first chamber and a stirring chamber 32 as a second chamber by a partition wall 38 extending in a vertical direction. The developing chamber 31 and the stirring chamber 32 are connected with each other at longitudinal end portions through two communicating portions 39 provided in the partition wall 38. For that reason, between the developing chamber 31 and the stirring chamber 32, the developer can move through the communicating portions 39. The developing chamber 31 and the stirring chamber 32 are arranged with respect to a horizontal direction.

Inside the developing sleeve 70, a magnet roll, including a plurality of magnetic poles along a rotational direction of the developing sleeve 70, as a magnetic field generating means for generating a magnetic field for carrying the developer on the surface of the developing sleeve 70 is fixedly provided. The developer in the developing chamber 31 is scooped by the influence of the magnetic field of the magnetic pole of the magnetic roll, and is supplied to the developing sleeve 70. Thus, the developer is supplied from the developing chamber 31 to the developing sleeve 70, and therefore, the developing chamber 31 is also referred to as a supplying chamber.

In the developing chamber 31, a first feeding screw 33 as a feeding means for stirring and feeding the developer in the developing chamber 31 is provided opposed to the developing sleeve 70. The first feeding screw 33 includes a rotation shaft 33*a* as a rotatable shaft portion and a helical blade portion 33*b* as a developer feeding portion provided along an outer periphery of the rotation shaft 33*a*, and is supported rotatably relative to the developing container 50. At each of end portions of the rotation shaft 33*a*, a bearing member is provided.

Further, in the stirring chamber 32, a second feeding screw 34 as a feeding means for stirring and feeding the developer in the stirring chamber 32 in a direction opposite to a developer feeding direction of the first feeding screw 33 is provided. The second feeding screw 34 includes a rotation shaft 34*a* as a rotatable shaft portion and a helical blade portion 34*b* as a developer feeding portion provided along an outer periphery of the rotation shaft 34*a*, and is supported rotatably relative to the developing container 50. At each of end portions of the rotation shaft 34*a*, a bearing member is provided. Further, the first feeding screw 33 and the second feeding screw 34 are rotationally driven, whereby a circulating path in which the developer is circulated between the developing chamber 31 and the stirring chamber 32 through the communicating portions 39 is formed.

The developing container 50 is provided with a regulating blade (hereinafter, referred to as a doctor blade 36) as a developer regulating member for regulating an amount (also referred to as a developer coating amount) of the developer carried on the surface of the developing sleeve 70 so as to oppose the surface of the developing sleeve 70 in contact with the surface of the developing sleeve 70. The doctor blade 36 includes a coating amount regulating surface 36*r* as a regulating portion for regulating an amount of the developer carried on the developing sleeve 70. The doctor blade 36 is a resin-made doctor blade molded with a resin material. Incidentally, a structure of the doctor blade 36 (alone) will be described with reference to FIG. 5.

The doctor blade 36 is disposed opposed to the developing sleeve 70 via a predetermined gap (hereinafter, referred to as an SB gap) G between itself and the developing sleeve 70 over a longitudinal direction of the developing sleeve 70 (i.e., a direction parallel to a rotational axis of the developing sleeve 70). In the present invention, the SB gap G is a minimum distance between a maximum image region of the developing sleeve 70 and a maximum image region of the doctor blade 36. Incidentally, the maximum image region of the developing sleeve 70 refers to a region of the developing sleeve 70 corresponding to a maximum image region of an image region in which the image is formable on the surface of the photosensitive drum 1, with respect to the rotational axis direction of the developing sleeve 70. Further, the maximum image region of the doctor blade 36 refers to a region of the doctor blade 36 corresponding to the maximum image region of the image region in which the image is formable on the surface of the photosensitive drum 1, with respect to the rotational axis of the developing sleeve 70. In the First Embodiment, electrostatic latent images having a plurality of sizes are formable on the photosensitive drum 1, and therefore, the maximum image region refers to an image region corresponding to a largest size (for example, A3 size) of the plurality of sizes in which the electrostatic latent images are formable on the photosensitive drum 1. On the other hand, in a modified embodiment in which the electrostatic latent image having only one size is formable on the photosensitive drum 1, the maximum image region is read as an image region having the only one size in which the electrostatic latent image is formable on the photosensitive drum 1.

The doctor blade 36 is disposed substantially opposed to a peak position of magnetic flux density of the magnetic pole of the magnet roll. The developer supplied to the developing sleeve 70 is influenced by the magnetic field of the magnetic pole of the magnet roll. Further, the developer regulated and scraped off by the doctor blade 36 tends to stagnate at a portion upstream of the SB gap G. As a result, a developer stagnating portion is formed on a side upstream of the doctor blade 36 with respect to the rotational direction of the developing sleeve 70. Then, a part of the developer stagnating at the developer stagnating portion is fed so as to pass temperature the SB gap with rotation of the developing sleeve 70. At this time, a layer thickness of the developer passing through the SB gap G is regulated by the coating amount regulating surface 36*r* of the doctor blade 36. Thus, a thin layer of the developer is formed on the surface of the developing sleeve 70.

Then, the developer carried in a predetermined amount on the surface of the developing sleeve 70 is fed to the developing region with the rotation of the developing sleeve 70. Therefore, by adjusting a magnitude of the SB gap G, the amount of the developer fed to the developing region is adjusted. In the First Embodiment, when the magnitude of the SB gap G is adjusted, a target magnitude of the SB gap G (so-called target value of the SB gap G) is set at about 300 μm.

The developer fed to the developing region is magnetically raised in the developing region, so that magnetic chains are formed. By contact of the magnetic chains with the photosensitive drum 1, the toner in the developer is supplied to the photosensitive drum 1. Then, the electrostatic latent image formed on the surface of the photosensitive drum 1 is developed as the toner image. The developer on the surface of the developing sleeve 70 after passing through the developing region and supplying the toner to the photosensitive drum 1 (hereinafter, this developer is referred to as a developer after the developing step) is scraped off of the surface of the developing sleeve 70 by a repelling magnetic field formed between identical-polarity magnetic poles of the magnet roll. The developer, after the developing step, scraped off of the surface of the developing sleeve 70 drops in the developing chamber 31, and thus is collected in the developing chamber 31.

As shown in FIG. 4, in the developing device frame 30, a developer guiding portion 35 for guiding the developer so as to be fed toward the SB gap G is provided. The developer guiding portion 35 and the developing device frame 30 are integrally formed with each other, and the developing guiding portion 35 and the doctor blade 36 are formed separately from each other. The developer guiding portion 35 is formed inside the developing device frame 30 and is disposed on a side upstream of the coating amount regulating surface 36*r* of the doctor blade 36 with respect to the rotational direction of the developing sleeve 70. A flow of the developer is stabilized by the developer guiding portion 35 and thus a density of the developer is adjusted to provide a predetermined developer density, whereby a weight of the developer at a position where the coating amount regulating surface 36*r* of the doctor blade 36 is closest to the surface of the developing sleeve 36 can be determined.

Further, as shown in FIG. 4, the cover frame 40 is formed as a separate member from the developing device frame 30 and is mounted on the developing device frame 30. Further, the cover frame 40 covers a part of an opening of the developing device frame 30 so as to cover a part of an outer peripheral surface of the developing sleeve 70 over an entire region of the developing sleeve 70 with respect to the longitudinal direction of the developing sleeve 70. At this time, cover frame 40 covers a part of the opening of the developing device frame 30 so that the developing region where the developing sleeve 70 opposes the photosensitive drum 1 exposes. In the First Embodiment, the cover frame 40 is fixed to the developing device frame 30 by ultrasonic bonding, but a fixing method of the developing device frame 30 to the cover frame 40 may also be either one of screw fastening, snap fitting, bonding, welding, or the like. Incidentally, as regards the cover frame 40, as shown in FIG. 4, the cover frame 40 may be constituted by a single part (resin mold product) and may also be constituted by a plurality of parts (resin mold products).

(Structure of Resin-Made Doctor Blade)

The structure of the doctor blade (alone) will be described using a perspective view of FIG. 5.

During the image forming operation (developing operation), pressure of the developer generating from a flow of the developer (hereinafter, this pressure is referred to as developer pressure) is exerted on the doctor blade 36. With decreasing rigidity, when the developer pressure is exerted on the doctor blade 36 during the image forming operation, the doctor blade 36 is liable to deform and there is a tendency that the magnitude of the SB gap G is liable to fluctuate. During the image forming operation, the developer pressure is applied in a widthwise direction (an arrow M direction of FIG. 5) of the doctor blade 36. Therefore, in order to suppress a fluctuation in magnitude of the SB gap G during the image forming operation, it is desirable that the doctor blade 36 is made strong against deformation with respect to the widthwise direction thereof by increasing the rigidity of the doctor blade 36 with respect to the widthwise direction.

Figure 5:
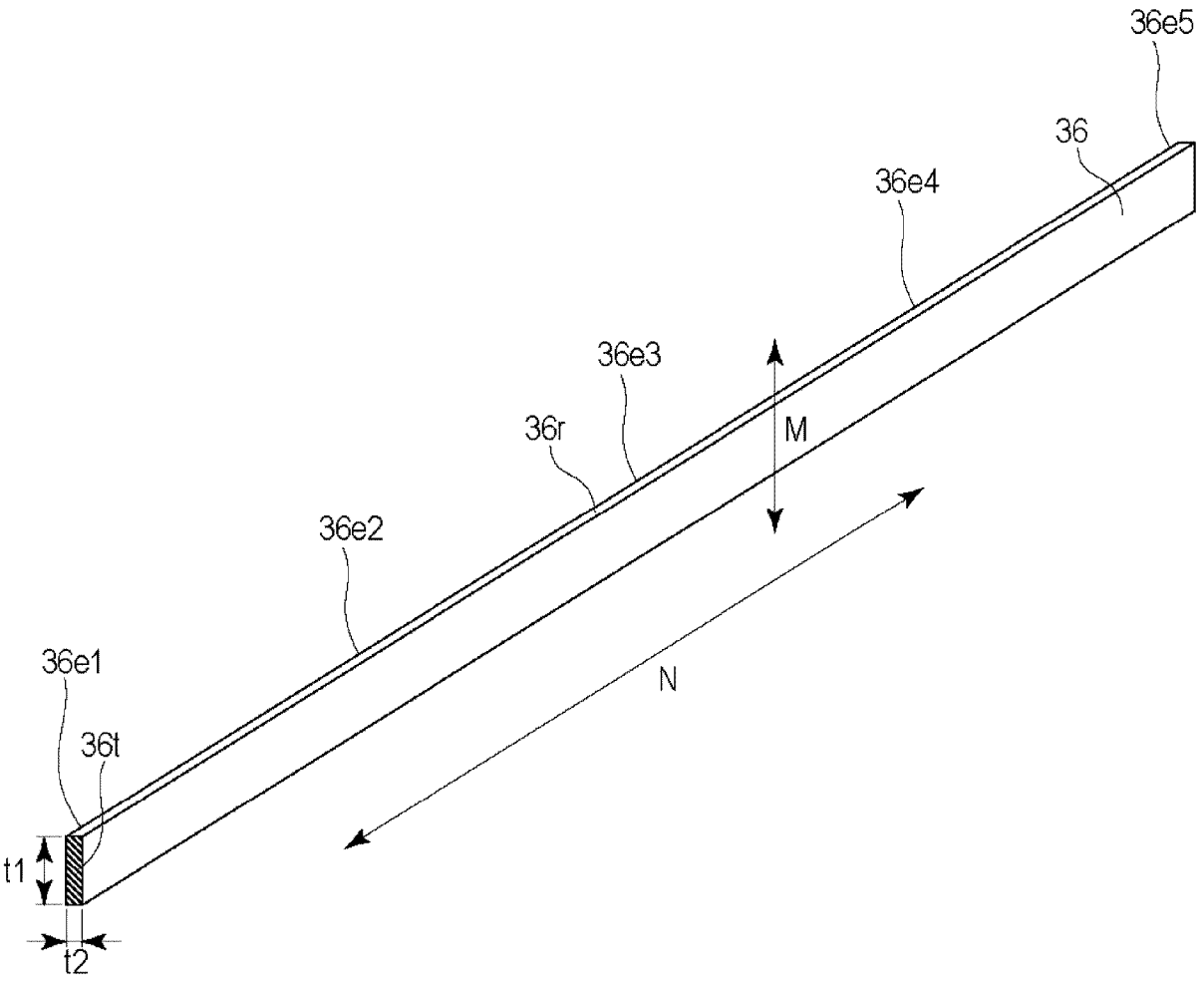
FIG. 5 is a perspective view showing a structure of a resin-made doctor blade (alone).

As shown in FIG. 5, in the First Embodiment, a shape of the doctor blade 36 is a plate shape from viewpoints of mass production and a cost. Further, as shown in FIG. 5, in this embodiment, a cross-sectional area of a side surface 36*t* of the doctor blade 36 is made small, and a length t2 of the doctor blade 36 with respect to a thickness direction is made smaller than a length $t_1$ of the doctor blade 36 with respect to a widthwise direction of the doctor blade 36. As a result, the doctor blade 36 (alone) has a constitution in which the doctor blade 36 is liable to deform in a direction (an arrow M direction of FIG. 5) perpendicular to the longitudinal direction (an arrow N direction of FIG. 5) of the doctor blade 36. Therefore, in this embodiment, in order to correct straightness of the coating amount regulating surface 36*r*, in a state in which at least a part of the doctor blade 36 is flexed in the arrow M direction of FIG. 5, the doctor blade 36 is fixed to a blade mounting portion 41 of the developing device frame 30. Incidentally, details of correction of the straightness will be described later with reference to FIG. 9.

(Structure of Resin-Made Developing Device Frame)

Figure 6:
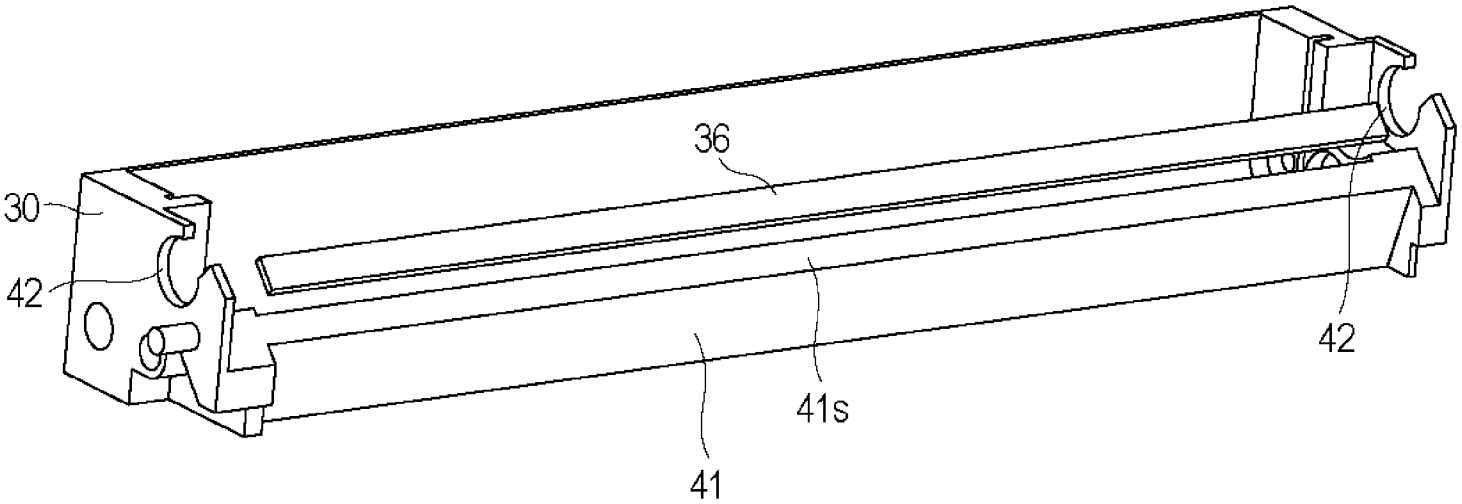
FIG. 6 is a perspective view showing a structure of a resin-made developing device frame (alone).

The structure of the developing device frame 30 (alone) will be described using a perspective view of FIG. 6. FIG. 6 shows a state in which the cover frame 40 is not mounted on the developing device frame 30.

The developing device frame 30 includes the developing chamber 31 and the stirring chamber 32 which is partitioned from the developing chamber 31 by the partition wall 38. The partition wall 38 is molded with a resin material, and may also be formed separately from the developing device frame 30 and may also be formed integrally with the developing device frame 30.

The developing device frame 30 includes a sleeve supporting portion 42 for rotatably supporting the developing sleeve 70 by supporting the bearings 71 provided at the longitudinal end portions of the developing sleeve 70. The developing device frame 30 further includes the blade mounting portion 41, formed integrally with the sleeve supporting portion 42, for mounting the doctor blade 36. FIG. 6 shows a phantom state in which the doctor blade 36 is caused to float from the blade mounting portion 41.

In this embodiment, in a state in which the doctor blade 36 is mounted on the blade mounting portion 41, an adhesive A applied onto a blade mounting surface 41*s* of the blade mounting portion 41 is cured, so that the doctor blade 36 is fixed on the blade mounting portion 41.

(Rigidity of Resin-Made Doctor Blade)

The rigidity of the doctor blade 36 (alone) will be described using a schematic view of FIG. 7. The rigidity of the doctor blade 36 is measured in a state in which the doctor blade 36 is not fixed on the blade mounting portion 41 of the developing device frame 30.

Figure 7:
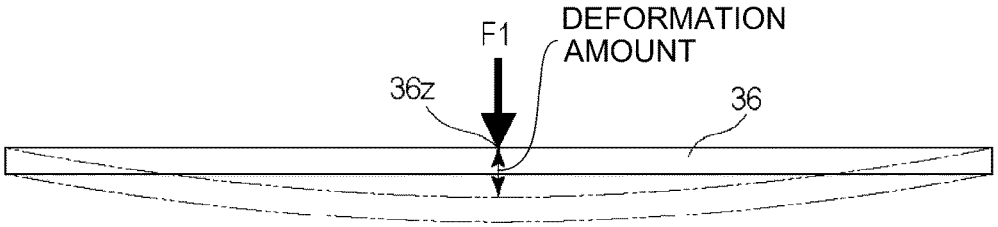
FIG. 7 is a schematic view for illustrating a rigidity of the resin-made doctor blade (alone).

As shown in FIG. 7, a concentrated load F1 is exerted in the widthwise direction of the doctor blade 36 on a central portion 36*z* of the doctor blade 36 with respect to the longitudinal direction of the doctor blade 36. At this time, the rigidity of the doctor blade 36 (alone) is measured on the basis of an amount of flexure of the doctor blade 36 in the widthwise direction at the central portion 36*z* of the doctor blade 36.

For example, it is assumed that the concentrated load F1 of 300 gf is exerted in the widthwise direction of the doctor blade 36 on the central portion 36*z* of the doctor blade 36 with respect to the longitudinal direction of the doctor blade 36. At this time, at the central portion 36*z* of the doctor blade 36, the amount of flexure of the doctor blade 36 in the widthwise direction is 700 μm or more. Incidentally, at this time, an amount of deformation in cross-section of the doctor blade 36 at the central portion 36*z* is 5 μm or less.

(Rigidity of Resin-Made Developing Device Frame)

The rigidity of the developing device frame 30 (alone) will be described using a schematic view of FIG. 8. The rigidity of the developing device frame 30 is measured in a state in which the doctor blade 36 is not fixed on the blade mounting portion 41 of the developing device frame 30.

Figure 8:
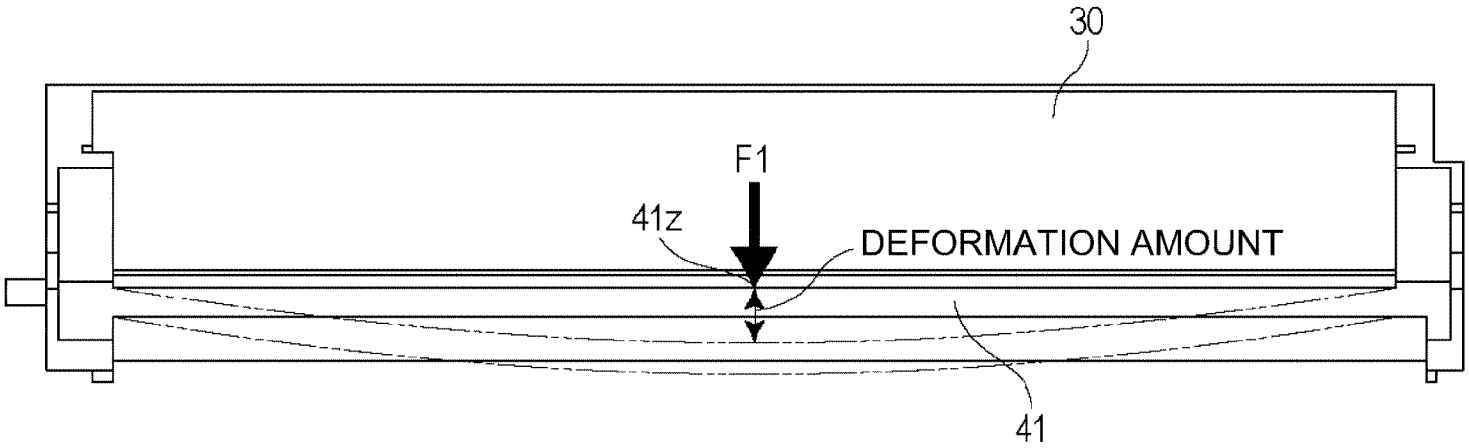
FIG. 8 is a schematic view for illustrating rigidity of the resin-made developing device frame (alone).

As shown in FIG. 8, a concentrated load F1 is exerted in the widthwise direction of the blade mounting portion 41 on a central portion 41*z* of the blade mounting portion 41 with respect to the longitudinal direction of the blade mounting portion 41. At this time, the rigidity of the developing device frame 30 (alone) is measured on the basis of an amount of flexure of the blade mounting portion 41 in the widthwise direction at the central portion 41*z* of the blade mounting portion 41.

For example, it is assumed that the concentrated load F1 of 300 gf is exerted in the widthwise direction of the blade mounting portion 41 on the central portion 41*z* of the blade mounting portion 41 with respect to the longitudinal direction of the blade mounting portion 41. At this time, at the central portion 41*z* of the blade mounting portion 41, the amount of flexure of the blade mounting portion 41 in the widthwise direction is 60 μm or less.

It is assumed that the same concentrated load F1 in magnitude is exerted on each of the central portion 36*z* of the doctor blade 36 and the central portion 41*z* of the blade mounting portion 41. At this time, the amount of flexure of the doctor blade 36 at the central portion 36*z* is not less than 10 times higher than the amount of flexure of the blade mounting portion 41 at the central portion 41*z*. Therefore, the rigidity of the developing device frame 30 (alone) is not less than 10 times higher than the rigidity of the doctor blade 36 (alone). For that reason, in a state in which the doctor blade 36 is mounted on the blade mounting portion 41 of the developing device frame 30 and is fixed on the blade mounting portion 41 of the developing device frame 30, compared with the rigidity of the doctor blade 36, the rigidity of the developing device frame 30 is predominant. Further, in the case where the doctor blade 36 is fixed on the developing device frame 30 over an entire area of the maximum image region, compared with the case where the doctor blade 36 is fixed on the developing device frame 30 only at the longitudinal end portions, the rigidity of the doctor blade 36 in a state in which the doctor blade 36 is fixed on the developing device frame 30 becomes high.

Further, the rigidity of the developing device frame 30 (alone) is larger than the rigidity of the cover frame 40 (alone). For that reason, in a state in which the cover frame 40 is mounted on the developing device frame 30 and is fixed to the developing device frame 30, compared with the rigidity of the cover frame 40, the rigidity of the developing device frame 30 is predominant.

(Correction of Straightness of Resin-Made Doctor Blade)

Correspondingly to an increase in width of the sheet S such as the case where the width of the sheet S on which the image is to be formed is an A3 size, with respect to a direction parallel to the rotational axis of the developing sleeve 70, a length of the maximum image region of the image region in which the image is formable on the surface of the photosensitive drum 1 becomes large. For that reason, the length of the maximum image region of the maximum image region becomes large correspondingly to the increase in width of the sheet S on which the image is to be formed. In the case where the doctor blade large in longitudinal length is molded with a resin material, it is difficult to ensure the straightness of the coating amount regulating surface of the resin-made doctor blade molded with the resin material. This is because in the case where the doctor blade large in longitudinal length is molded with the resin material, when the thermally expanded resin material thermally contracts, depending on the longitudinal position of the doctor blade, portions where the thickness advances and delays are liable to generate.

For that reason, as regards the resin-made doctor blade, there is a tendency that with an increasing length of the doctor blade with respect to the longitudinal direction, due to the straightness of the coating amount regulating surface of the doctor blade, the SB gap is liable to become different with respect to the longitudinal direction of the developer carrying member. When the SB gap is different with respect to the longitudinal direction of the developer carrying member, there is a liability that with respect to the longitudinal direction of the developer carrying member, non-uniformity of the amount of the developer carried on the surface of the developer carrying member occurs.

For example, in the case where the resin-made doctor blade having a length corresponding to a longitudinal length of an A3-size sheet (hereinafter, this doctor blade is referred to as an A3-size compatible resin-made doctor blade) is manufactured with accuracy of a general purpose resin mold product, the straightness of the coating amount regulating surface is about 300 μm-500 μm. Further, even if the A3-size compatible resin-made doctor blade is manufactured with high accuracy by using a high-accuracy resin material, the straightness of the coating amount regulating surface is about 100 μm-200 μm.

In this embodiment, the magnitude of the SB gap G is set at about 300μ, and a tolerance of the SB gap G (i.e., a tolerance with respect to the target value of the SB gap G) is set at within ±10%. Therefore, in this embodiment, this means that an adjusting value of the SB gap G is 300 μm±30 μm and that an allowable tolerance of the SB gap G is 60 μm to the maximum. For this reason, even when the A3-size compatible resin-made doctor blade is manufactured with the accuracy of the general purpose resin mold product or is manufactured with high accuracy by using a high-accuracy resin material, only by the accuracy of the straightness of the coating amount regulating surface, a resultant value exceeds an allowable range as the tolerance of the SB gap G.

In the developing device including the resin-made doctor blade, irrespective of the straightness of the coating amount regulating surface, in the state in which the doctor blade is fixed to the mounting portion of the developing device frame, it is desired that the SB gap G falls within a predetermined range over the direction parallel to the rotational axis of the developer carrying member. Therefore, in this embodiment, even when the resin-made doctor blade low in straightness of the coating amount regulating surface, by correcting the straightness of the coating amount regulating surface, in the state in which the doctor blade is fixed to the mounting portion of the developing device frame, the SB gap G is caused to fall within the predetermined range over the direction parallel to the rotational axis of the developing sleeve 70.

Here, the straightness of the coating amount regulating surface **36*r* of the doctor blade 36 will be described using a schematic view of FIG. 9. The straightness of the coating amount regulating surface 36*r* of the doctor blade 36 is represented by an absolute value of a difference between a maximum and a minimum of an outer configuration of the coating amount regulating surface 36*r* when a predetermined position of the coating amount regulating surface 36*r* with respect to the longitudinal direction of the coating amount regulating surface 36*r* is used as a reference position. For example, when a central portion of the coating amount regulating surface 36*r* with respect to the longitudinal direction of the coating amount regulating surface 36*r* is used as an origin of a rectangular (orthogonal) coordinate system, a predetermined rectilinear line passing through the origin is X-axis and a rectilinear line drawn from the origin perpendicularly to the X-axis is Y-axis. In this rectangular coordinate system, the straightness of the coating amount regulating surface 36*r* is represented by an absolute value of a difference between a maximum and a minimum of a Y-coordinate of the outer configuration of the coating amount regulating surface 36*r***.

Figure 9:
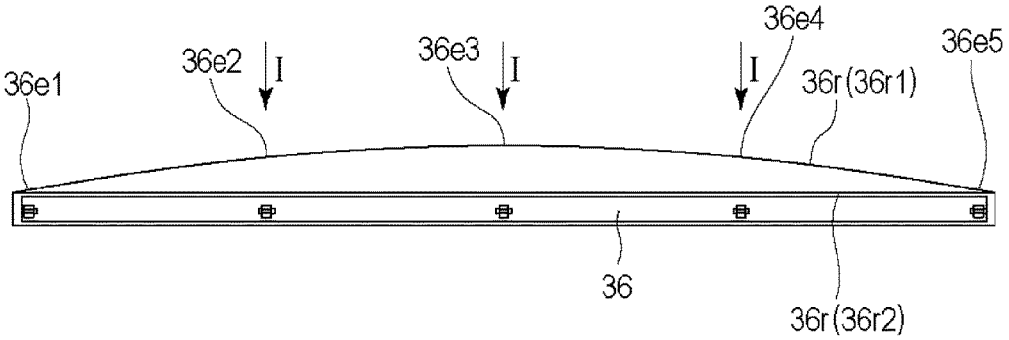
FIG. 9 is a schematic view for illustrating straightness of the resin-made doctor blade (alone).

As shown in FIG. 9, the resin-made doctor blade (alone) has a shape such that with respect to the longitudinal direction of the doctor blade 36, the coating amount regulating surface **36*r* of the doctor blade 36 largely flexes at the central portion. For that reason, there is a need to correct the straightness of the doctor blade 36 by decreasing a difference among positions of free end portions 36*e* (36*e*1 to 36*e*5). In view of an allowable value of the tolerance of the SB gap G, mounting accuracy of the doctor blade 36 on the developing device frame 30, and the like, the straightness of the coating amount regulating surface 36*r* of the doctor blade 36 is required to be corrected to 50 μm or less. Incidentally, in view of not more than 20 μm of the accuracy of the straightness of a metal-made doctor blade prepared by secondary cutting work of metal, the straightness of the coating amount regulating surface 36*r* of the doctor blade 36 may preferably be corrected to 20 μm or less. In this embodiment, in view of a practical mass-production step, a setting value of correction of the straightness of the coating amount regulating surface 36*r* of the doctor blade 36** is about 20 μm-50 μm.

Therefore, in this embodiment, a force for causing the doctor blade 36 to flex in at least a part of the maximum image region (hereinafter, this force is referred to as a straightness correcting force) is applied to the doctor blade 36, so that the doctor blade 36 is caused to flex in at least the part of the maximum image region. As a result, the straightness of the coating amount regulating surface 36*r* of the doctor blade 36 is corrected to not more than 50 μm.

In an example of FIG. 9, outer configurations of the free end portions 36*e*1 and 36*e*5 of the doctor blade 36 are used as references, and the straightness correcting force is applied on the basis of the references in arrow I directions to the free end portions 36*e*2, 36*e*3 and 36*e*4 so that outer configurations of the free end portions 36*e*2, 36*e*3 and 36*e*4 coincide with those of the free end portions 36*e*1 and 36*e*5. As a result, the shape of the coating amount regulating surface 36*r* of the doctor blade 36 is corrected from a coating amount regulating surface 36*r*1 to a coating amount regulating surface 36*r*2, so that the straightness of the coating amount regulating surface 36*r* of the doctor blade can be corrected to not more than 50 Incidentally, in the example of FIG. 9, the references when the outer configurations of the free end portions 36*r* of the doctor blade 36 are made the same were the outer configurations of the free end portions 36*e*1 and 36*e*5 (longitudinal end portions of the coating amount regulating surface 36*r*), but may also be the outer configuration of the free end portion 36*e*3 (longitudinal central portion of the coating amount regulating surface 36*r*). In that case, the outer configuration of the free end portion 36*e*3 of the doctor blade 36 is used as a reference, and the straightness correcting force is applied to the doctor blade 36 so that outer configurations of the free end portions 36*e*1, 36*e*2, 36*e*4 and 36*e*5 coincide with the outer configuration of the free end portion 36*e*3.

Thus, in order to make the straightness correction of the doctor blade 36, there is a need to lower the rigidity of the doctor blade (alone) so that the doctor blade 36 is flexed in at least the part of the maximum image region of the coating amount regulating surface 36*r* when the straightness correcting force is applied to the doctor blade 36.

(SB Gap Adjusting Method)

Adjustment of the SB gap G is carried out by moving the position of the doctor blade 36 relative to the developing device frame 30 so that a relative position of the doctor blade 36 mounted on the blade mounting portion 41 is adjusted with respect to the developing sleeve 70 supported by the sleeve supporting portion 42. At a predetermined position of the blade mounting portion 41 determined by adjusting the SB gap G, the doctor blade 36 flexed in at least the part of the maximum image region of the doctor blade 36 is fixed with the adhesive A applied over the entire area of the maximum image region of the blade mounting surface 41*s* in advance. Incidentally, the maximum image region of the blade mounting surface 41*s* refers to a region of the blade mounting surface 41*s* corresponding to a maximum image region of the image region in which the image is formable on the surface of the photosensitive drum 1. At this time, of the maximum image region of the doctor blade 36, as regards a region in which the doctor blade 36 is flexed for correcting the straightness of the coating amount regulating surface 36*r*, the doctor blade 36 is fixed to the blade mounting portion 41. Incidentally, when the doctor blade 36 is fixed to the blade mounting portion 41 with the adhesive A in a region where a force for flexing the doctor blade 36 in at least the part of the maximum image region is applied, the adhesive A is not required to be applied onto a part of the blade mounting surface 41*s*. Therefore, that the adhesive A is applied over the entire area of the maximum image region of the blade mounting surface 41*s* satisfies the following condition. The adhesive A is applied in a region which includes the region, of the region corresponding to the maximum image region of the doctor blade 36, in which the doctor blade 36 is flexed for correcting the straightness of the coating amount regulating surface 36*r* and which is not less than 95% of the maximum image region of the blade mounting surface 41*s*.

As a result, of the maximum image region of the doctor blade 36, in the region in which the doctor blade 36 is flexed for correcting the straightness of the coating amount regulating surface 36*r*, it is possible to suppress a phenomenon that the state of the doctor blade 36 is likely to be returned from a flexed state to an original state before the flexure. By doing so, the doctor blade 36 is fixed to the blade mounting portion 41 in a state in which the straightness of the coating amount regulating surface 36*r* is corrected to not more than 50 μm.

Incidentally, in this embodiment, the magnitude of the SB gap G is measured (calculated) by a method described below. Incidentally, measurement of the magnitude of the SB gap G is carried out in a state in which the developing sleeve 70 is supported by the sleeve supporting portion 42 of the developing device frame 30 and the doctor blade 36 is mounted on the blade mounting portion 41 and in which the cover frame 40 is fixed to the developing device frame 30.

When the magnitude of the SG gap G is measured, a light source (for example, an LED array, a light guide or the like) is inserted into the developing chamber 31 over the longitudinal direction of the developing chamber 31. The light source inserted in the developing chamber 31 emits light toward the SB gap G from an inside of the developing chamber 31. Further, at each of five places corresponding to the free end portions 36*e* (36*e*1 to 36*e*5) of the doctor blade 36, a camera for picking up a light beam emitted to an outside of the developing device frame 30 through the SB gap G is provided.

The cameras disposed at the five places pick up light beams emitted to the outside of the developing device frame 30 through the SB gap G in order to measure the respective positions of the free end portions 36*e* (36*e*1 to 36*e*5) of the doctor blade 36. At that time, the cameras read a closest position of the developing sleeve 70 with the doctor blade 36 on the surface of the developing sleeve 70 and read the free end portions 36*e* (36*e*1 to 36*e*5) of the doctor blade 36. Then, pixel values are converted from image data generated by being read with the cameras into distances, so that the magnitude of the SB gap G is calculated. In the case where the calculated magnitude of the SB gap G does not fall within a predetermined range, adjustment of the SB gap G is carried out. Then, when the calculated magnitude of the SB gap G falls within the predetermined range, the position is determined as a position where the doctor blade 36 flexed in at least the part of the maximum image region of the doctor blade 36 is fixed to the blade mounting portion 41 of the developing device frame 30.

Incidentally, in this embodiment, by a method described later, whether or not the SB gap G falls within the predetermined range over a direction parallel to the rotational axis of the developing sleeve 70 is discriminated. First, the maximum image region of the doctor blade 36 is equidistantly divided into four or more regions, and in each of the divided regions (but including both end portions and a central portion of the maximum image region of the doctor blade 36), the SB gap G is measured at five places or more. Then, from samples of measured values of the SB gap G measured at five places or more, a maximum value, a minimum value and a median value of the SB gap G are extracted.

At this time, an absolute value of a difference between the maximum value and the median value of the SB gap G may only be required to be not more than 10% of the median value of the SB gap G, and an absolute value of a difference between the minimum value and the median value of the SB gap G may only be required to be not more than 10% of the median value of the SB gap G. In this case, on assumption that the tolerance of the SB gap G is ±10% or less, the SB gap G satisfies that the SB gap G falls within the predetermined range over the direction parallel to the rotational axis of the developing sleeve 70. For example, in the case where from the samples of the measured values of the SB gap G measured at five places or more, the median value of the SB gap G was 300 μm, it may only be required that the maximum value of the SB gap G is 330 μm or less and the minimum value of the SB gap G is 270 μm or more. That is, in this case, an adjusting value of the SB gap G is 300 μm±30 μm, so that as the tolerance of the SB gap G, up to 60 μm at the maximum is permitted.

(Linear Expansion Coefficient)

Then, deformation of the doctor blade 36 and the developing device frame 30 due to a change in temperature by heat generated during the image forming operation will be described using a perspective view of FIG. 10. As heat generating during the image forming operation, for example, there are heat generating during rotation of the rotation shaft of the developing sleeve 70 and the bearing 71, heat generating during rotation of the rotation shaft 33*a* of the first feeding screw 33 and the bearing member thereof, and heat generating when the developer passes through the SB gap G, and the like. By the heat generated during the image forming operation, an ambient temperature of the developing device 3 changes, so that temperatures of the doctor blade 36, the developing device frame 30 and the cover frame 40 also change.

Figure 10:
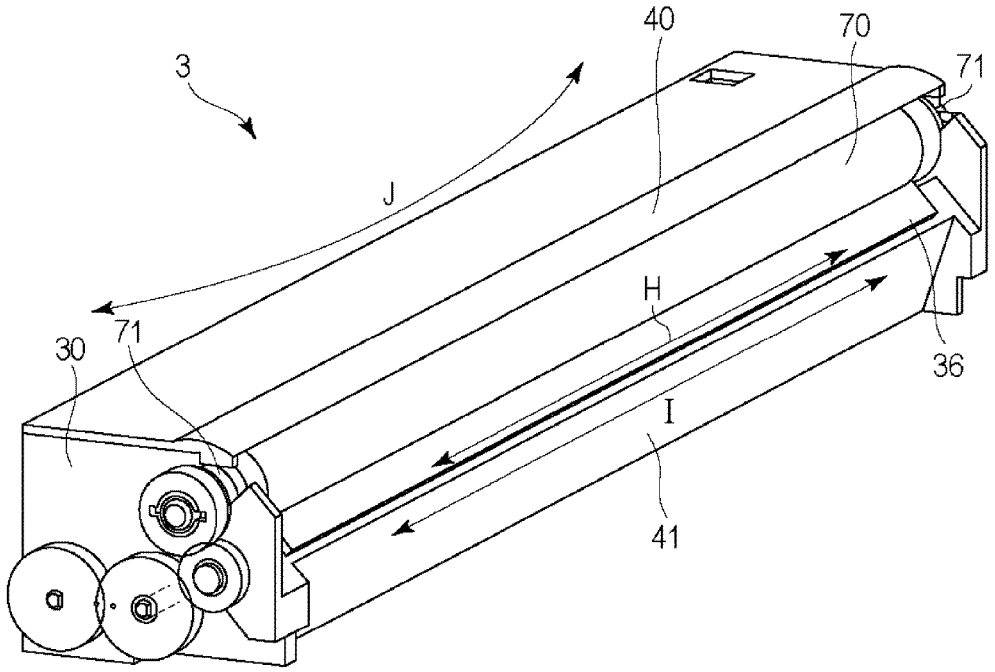
FIG. 10 is a perspective view for illustrating deformation of the resin-made doctor blade due to a temperature change.

As shown in FIG. 10, an elongation amount of the doctor blade 36 due to the temperature change is H (μm), and an elongation amount of the blade mounting surface 41*s* of the blade mounting portion 41 of the developing device frame 30 is I (μm). Further, a linear expansion coefficient α1 of the resin material constituting the doctor blade 36 and a linear expansion coefficient α2 of the resin material contacting the developing device frame 30 are different from each other. In this case, due to a difference between these linear expansion coefficients, deformation amounts of the developing device frame 30 and the doctor blade 36 by the temperature changes are different from each other, so that in order to eliminate a difference between H (μm) and I (μm), the doctor blade 36 deforms in an arrow J direction of FIG. 10. The deformation of the doctor blade 36 in the arrow J direction of FIG. 10 is referred to as deformation of the doctor blade 36 in a warping direction. Further, the deformation of the doctor blade 36 in the warping direction leads to a fluctuation in magnitude of the SB gap G. In order to suppress the fluctuation in magnitude of the SB gap G resulting from the heat, the linear expansion coefficient α2 of the resin material constituting the sleeve supporting portion 42 and the blade mounting portion 41 of the developing device frame 30 (alone) and the linear expansion coefficient α1 of the resin material constituting the doctor blade 36 (alone) are associated with each other. That is, in the case where the linear expansion coefficient α1 of the resin material constituting the doctor blade 36 and the linear expansion coefficient α2 of the resin material constituting the developing device frame 30 are different from each other, due to the difference between these linear expansion coefficients, an amount of a change resulting from the temperature change varies.

In general, the resin material is larger in linear expansion coefficient than the metal material. In the case where the doctor blade 36 is made of the resin material, with the temperature change by the heat generating during the image forming operation, the warping deformation of the doctor blade 36 occurs, so that the doctor blade 36 is liable to flex at the longitudinal central portion. As a result, in the photosensitive drum in which the resin-made doctor blade 36 is fixed to the resin-made developing device frame, the magnitude of the SB gap G is liable to fluctuate with the temperature change during the image forming operation.

(Structure of Developing Device According to First Embodiment)

In the First Embodiment, in order to correct the straightness of the coating amount regulating surface 36*r* to not more than 50 μm, the doctor blade 36 is flexed in at least the part of the maximum image region thereof. Further, a method in which the doctor blade 36 flexed in at least the part of the maximum image region is fixed to the blade mounting portion 41 of the developing device frame 30 with the adhesive A over the entire area of the maximum image region of the doctor blade 36 is employed.

At this time, in the case where there is a large difference between the linear expansion coefficient α2 of the resin material constituting the developing device frame 30 and the linear expansion coefficient α1 of the resin material constituting the doctor blade 36, when the temperature change occurs, the following problem arises. That is, when the temperature change occurs, a deformation amount (expansion/contraction amount) of the doctor blade 36 due to the temperature change and a deformation amount (expansion/contraction amount) of the developing device frame 30 due to the temperature change are different from each other. As a result, even in the case where the SB gap G is adjusted with high accuracy when the position where the doctor blade 36 is mounted on the blade mounting surface 41*s* of the developing device frame 30 is determined, the magnitude of the SB gap G is fluctuated due to the temperature change during the image forming operation.

In this embodiment, the doctor blade 36 is fixed to the blade mounting surface 41*s* over the entire area of the maximum image region, and therefore, there is a need to suppress the fluctuation in magnitude of the SB gap G resulting from the temperature change during the image forming operation. As regards the fluctuation amount of the SB gap G due to the heat, with respect to the longitudinal direction of the developing sleeve 70, in order to suppress non-uniformity of the amount of the developer carried on the surface of the developing sleeve 70, there is a need to suppress the fluctuation amount to not more than ±20 μm in general.

A difference of the linear expansion coefficient α2 of the resin material constituting the developing device frame 30 including the sleeve supporting portion 42 and the blade mounting portion 41 from the linear expansion coefficient α1 of the resin material constituting the doctor blade 36 is hereinafter referred to as a linear expansion coefficient difference (α2−α1). A change in maximum flexure amount of the doctor blade 36 due to this linear expansion coefficient difference (α2−α1) will be described using Table 1. In a state in which the doctor blade 36 was fixed to the blade mounting portion 41 of the developing device frame 30 over the entire area of the maximum image region of the doctor blade 36, measurement of the maximum flexure amount of the doctor blade when the temperature change from a normal temperature (23° C.) to a high temperature (40° C.) was made was carried out.

The linear expansion coefficient of the resin material constituting the developing device frame 30 including the sleeve supporting portion 42 and the blade mounting portion 41 is $\alpha 2$ (m/° C.), and the linear expansion coefficient of the resin material constituting the doctor blade 36 is $\alpha 1$ (m/° C.). Then, the linear expansion coefficient difference ($\alpha 2-\alpha 1$) was changed, and the maximum flexure amount of the doctor blade 36 was measured. A result thereof is shown in Table 1. In Table 1, in the case where the absolute value of the maximum flexure amount is not more than 20 μm, the maximum flexure amount is evaluated as "o", and in the case where the absolute value of the maximum flexure amount is larger than 20 μm, the maximum flexure amount is evaluated as "x".

TABLE 1

| $\alpha 2-\alpha 1$ [$\times 10^{-5}$ m/° C.]: | | | | | | | | | |
|---|---|---|---|---|---|---|---|---|---|
| | 0 | +0.20 | +0.40 | +0.50 | +0.54 | +0.55 | +0.56 | +0.57 | +0.60 |
| MFA*1 | o | o | o | o | o | o | x | x | x |
| | 0 | −0.20 | −0.40 | −0.44 | −0.45 | −0.46 | −0.47 | −0.50 | |
| MFA*1 | o | o | o | o | o | x | x | x | |

*1"MFA" is the maximum flexure amount of the doctor blade.

As is understood from Table 1, in order to suppress the fluctuation amount of the SB gap G due to the heat to not more than ±20 μm, there is a need that the linear expansion coefficient difference ($\alpha 2-\alpha 1$) satisfies the following relationship (1):

$$-0.45\times 10^{-5}\ (\text{m/° C.})\leq \alpha 2-\alpha 1\leq 0.55\times 10^{-5}\ (\text{m/° C.}) \quad (1).$$

Therefore, the resin material constituting the developing device frame 30 and the resin material constituting the doctor blade 36 may only be required to be selected so that the linear expansion coefficient difference ($\alpha 2-\alpha 1$) is $-0.45\times 10^{-5}$ (m/° C.) or more and $0.55\times 10^{-5}$ (m/° C.) or less. Incidentally, the same resin material is selected as the resin material constituting the developing device frame 30 and the resin material constituting the doctor blade 36, the linear expansion coefficient difference ($\alpha 2-\alpha 1$) becomes zero.

Incidentally, when the adhesive A is applied onto the doctor blade 36 and the developing device frame 30, the doctor blade 36 and the developing device frame 30 on which the adhesive A is applied fluctuated in linear expansion coefficient. However, a volume itself of the adhesive A applied onto the doctor blade 36 and the developing device frame 30 is very small, so that the influence thereof on a dimensional fluctuation due to the temperature change with respect to a thickness direction of the adhesive A is at a negligible level. For that reason, when the adhesive A is applied onto the doctor blade 36 and the developing device frame 30, the deformation of the doctor blade 36 in the warping direction due to the fluctuation in linear expansion coefficient difference ($\alpha 2-\alpha 1$) is at a negligible level.

Similarly, the cover frame 40 is fixed to the developing device frame 30, and therefore, when the deformation amounts of the developing device frame 30 and the cover frame 40 due to the temperature change are different from each other, the deformation of the cover frame 40 in the warping direction heads to the fluctuation in magnitude of the SB gap G. The linear expansion coefficient of the resin material constituting the developing device frame 30 including the sleeve supporting portion 42 and the blade mounting portion 41 is $\alpha 2$ (m/° C.), and the linear expansion coefficient of the resin material constituting the cover frame 40 is $\alpha 3$ (m/° C.). Further, a difference of the linear expansion coefficient $\alpha 3$ of the resin material constituting the cover frame 40 from the linear expansion coefficient $\alpha 2$ of the resin material constituting the developing device frame 30 including the sleeve supporting portion 42 and the blade mounting portion 41 is hereinafter referred to as a linear expansion coefficient difference ($\alpha 3-\alpha 2$).

At this time, similarly as in the case of Table 1, there is a need that the linear expansion coefficient difference ($\alpha 3-\alpha 2$) satisfies the following relationship (2):

$$-0.45\times 10^{-5}\ (\text{m/° C.})\leq \alpha 3-\alpha 2\leq 0.55\times 10^{-5}\ (\text{m/° C.}) \quad (2).$$

Therefore, the resin material constituting the developing device frame 30 and the resin material constituting the cover frame 40 may only be required to be selected so that the linear expansion coefficient difference ($\alpha 3-\alpha 2$) is $-0.45\times 10^{-5}$ (m/° C.) or more and $0.55\times 10^{-5}$ (m/° C.) or less. Incidentally, the same resin material is selected as the resin material constituting the developing device frame 30 and the resin material constituting the cover frame 40, the linear expansion coefficient difference ($\alpha 3-\alpha 2$) becomes zero.

(Developer Pressure)

Figure 11:
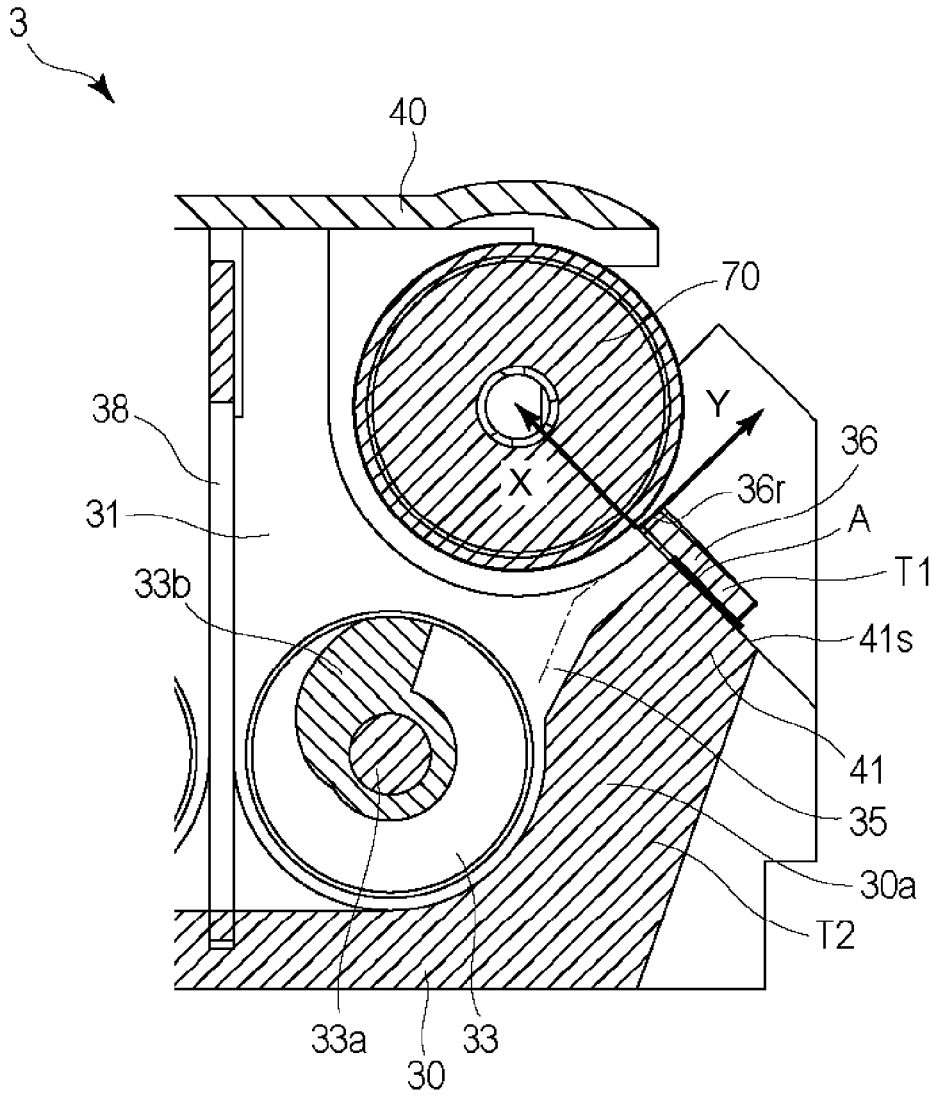
FIG. 11 is a sectional view for illustrating deformation of the resin-made doctor blade due to developer pressure.

Then, the deformation of the doctor blade 36 resulting from application, to the doctor blade 36, of the developer pressure generating from a flow of the developer will be described using a sectional view of FIG. 11. FIG. 11 is the sectional view of the developing device 3 in a cross-section (cross-section H of FIG. 2) perpendicular to the rotational axis of the developing sleeve 70. Further, FIG. 11 shows a structure of a neighborhood of the doctor blade 36 fixed to the blade mounting portion 41 of the developing device frame 30 with the adhesive A.

As shown in FIG. 11, a line connecting a closest position of the doctor blade 36 to the developing sleeve 70 on the coating amount regulating surface **36*r* is X-axis. At this time, the doctor blade 36 is long in length with respect to the X-axis and is high in rigidity in cross-section along the X-axis. Further, as shown in FIG. 11, a proportion of a cross-sectional area T1 of the doctor blade 36 to a cross-sectional area T2 of a wall portion 30*a* of the developing device frame 30 positioned in the neighborhood of the developer guiding portion 35** is small.

As described above, in this embodiment, the rigidity of the developing device frame 30 (alone) is made higher than the rigidity of the doctor blade 36 (alone) by ten times or more. Accordingly, in a state in which the doctor blade 36 is fixed to the blade mounting portion 41 of the developing device frame 30, the rigidity of the developing device frame 30 is predominant over the rigidity of the doctor blade 36. As a result, during the image forming operation, a displacement amount (maximum flexure amount) of the coating amount regulating surface **36*r* of the doctor blade 36 when the developer pressure is applied to the doctor blade 36 is substantially equivalent to a displacement amount (maximum flexure amount) of the developing device frame 30**.

During the image forming operation, the developer scooped from the first feeding screw 33 passes through the developer guiding portion 35 and is fed to the surface of the developing sleeve 70. Thereafter, even when a layer thickness of the developer is regulated to the magnitude of the SB gap G by the doctor blade 36, the doctor blade 36 is subjected to the developer pressure from various directions. As shown in FIG. 11, when a direction perpendicular to the X-axis direction (a direction in which the SB gap G is defined) is a Y-axis direction, the developer pressure along the Y-axis direction is perpendicular to the blade mounting surface **41*s* of the developing device frame 30. That is, the developer pressure with respect to the Y-axis direction is a force for peeling off the doctor blade 36 of the blade mounting surface 41***s*. Therefore, a binding force by the adhesive A is required to be sufficiently larger than the developer pressure with respect to the Y-axis direction. Therefore, in this embodiment, in consideration of the force for peeling off the doctor blade 36 of the blade mounting surface 41*s* by the developer pressure and of an adhesive force of the adhesive A, an adhesive area and application thickness of the adhesive A onto the blade mounting surface 41*s* are optimized.

As described above, in this embodiment, the resin-made doctor blade 36 is fixed to the blade mounting portion 41 of the resin-made developing device frame 30 with the adhesive A over the entire area of the maximum image region of the doctor blade 36. Further, in this embodiment, when the resin-made doctor blade 36 is fixed to the blade mounting portion 41 of the resin-made doctor blade 36, in order to correct the straightness of the doctor blade 36 (alone), the resin-made doctor blade 36 having a low rigidity is used. If the rigidity of the doctor blade 36 (alone) is increased by increasing the thickness of the doctor blade 36 or by providing a rib on the doctor blade 36, even when the straightness correcting force is applied to the doctor blade 36, the doctor blade 36 is not readily flexed in the maximum image region of the coating amount regulating surface 36*r*. For that reason, as regards the resin-made doctor blade 36 (alone) having a large rigidity, it is difficult to make the straightness connection of the doctor blade 36. Therefore, in this embodiment, the resin-made doctor blade having the low rigidity is used.

In the developing device 3 in which the resin-made doctor blade 36 having the low rigidity is fixed to the resin-made developing device frame 30, there is a need to enhance the rigidity of the doctor blade 36 in a state of being fixed to the developing device frame 30, by enhancing the rigidity of the blade mounting portion 41 of the developing device frame 30. This is because by enhancing the rigidity of the doctor blade 36 in the state of being fixed to the developing device frame 30, the fluctuation in SB gap G due to the developer pressure during the image forming operation is suppressed and the SB gap G falls within the predetermined range during the image forming operation.

In order to enhance the rigidity of the blade mounting portion 41 of the developing device frame 30, it would be considered that the thickness of the blade mounting portion 41 of the developing device frame 30 is made large. However, in general, as regards the resin mold product larger in magnitude of the thickness than a predetermined value, compared with the resin mold product having the magnitude of the thickness not more than the predetermined value, when the resin material thermally expanded during the molding thermally contracts, a degree of generation of a difference in progress of thermal contraction between an inside and an outside of the resin mold product is liable to become large. In other words, the resin mold product larger in magnitude of the thickness than the predetermined value is liable to become non-uniform in mold shrinkage rate compared with the resin mold product having the magnitude of the thickness not more than the predetermined value. This is because the resin material thermally expanded during the molding is gradually cooled from the outside of the resin mold product which is a portion contacting a metal mold toward the inside of the resin mold product which is a portion not contacting the metal mold, and thus the thermal contraction progresses. Therefore, the resin mold product larger in magnitude of the thickness than the predetermined value has a tendency that sink marks are liable to generate compared with the resin mold product having the magnitude of the thickness not more than the predetermined value.

Further, as regards the resin mold product, with an increasing magnitude of the thickness, a cooling time and a cycle time during the molding become long, and therefore, the resin mold product is disadvantageous from a viewpoint of the mass-productivity. For that reason, there is a limit to a degree of the increase in magnitude of the thickness of the blade mounting portion 41 of the developing device frame 30 for the purpose of enhancing the rigidity of the blade mounting portion 41 of the developing device frame 30. Therefore, in this embodiment, in order to prevent the resin mold product from being disadvantageous from the viewpoint of the mass-productivity, the magnitude of the thickness is set at 1.0 mm or more and 3.0 mm or less.

In order not to make the mold shrinkage rate non-uniform, in general, the magnitude of a basic thickness of the developing device frame 30 may preferably be made uniform. Therefore, in this embodiment, the magnitude of the basic thickness of the developing device frame 30 and the magnitude of the thickness of the blade mounting portion 41 of the developing device frame 30 are made equal to each other. That is, in this embodiment, in order not to make the resin mold product disadvantageous from the viewpoint of the mass-productivity, the basic thickness of the developing device frame 30 is set at 1.0 mm or more and 3.0 mm or less.

As regards the developing device frame 30 having the magnitude of the basic thickness not more than the predetermined value, in order to enhance the rigidity of the blade mounting portion 41 of the developing device frame 30, it would be considered that the blade mounting portion 41 of the developing device frame 30 is provided with a rib. Specifically, the rib is provided in the maximum image region of the blade mounting portion 41 of the developing device frame 30, so that geometrical moment of inertia of the blade mounting portion 41 of the developing device frame 30 in a vertical section is increased. Incidentally, the maximum image region of the blade mounting portion 41 refers to a region of the blade mounting portion 41 corresponding to a maximum image region of the image region in which the image is formable on the surface of the photosensitive drum 1. Thus, in a state in which the resin-made doctor blade 36 having the low rigidity is fixed the resin-made developing device frame 30, the rib may desirably be provided in the maximum image region of the blade mounting portion 41 so that the fluctuation in magnitude of the SB gap G is suppressed during the image forming operation. Further, even in the case where the resin material is molded so as to provide the rib in the maximum image region of the blade mounting portion 41, it is also desired that the resin mold product is not disadvantageous from the viewpoint of the mass-productivity compared with the case where the resin material is molded so as not to provide the rib in the maximum image region of the blade mounting portion 41.

In the First Embodiment, the magnitude of the thickness of the blade mounting portion 41 of the developing device frame 30 is 1.0 mm or more and 3.0 mm or less, and the blade mounting portion 41 is provided with the rib (rib structure) over the entire area of the maximum image region of the blade mounting portion 41. As a result, the geometrical moment of inertia of the blade mounting portion 41 of the developing device frame 30 in the vertical section is increased, so that the rigidity of the blade mounting portion 41 of the developing device frame 30 is enhanced. Details thereof will be described.

Figure 12:
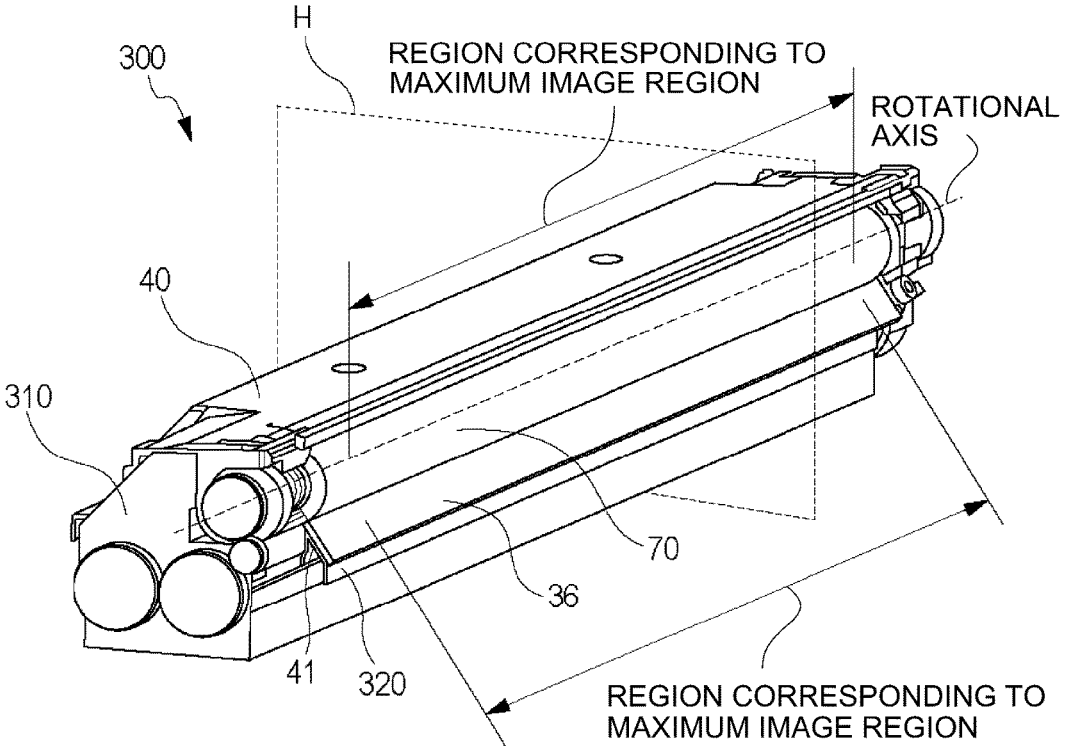
FIG. 12 is a perspective view showing a structure of a developing device according to a First Embodiment.
Figure 13:
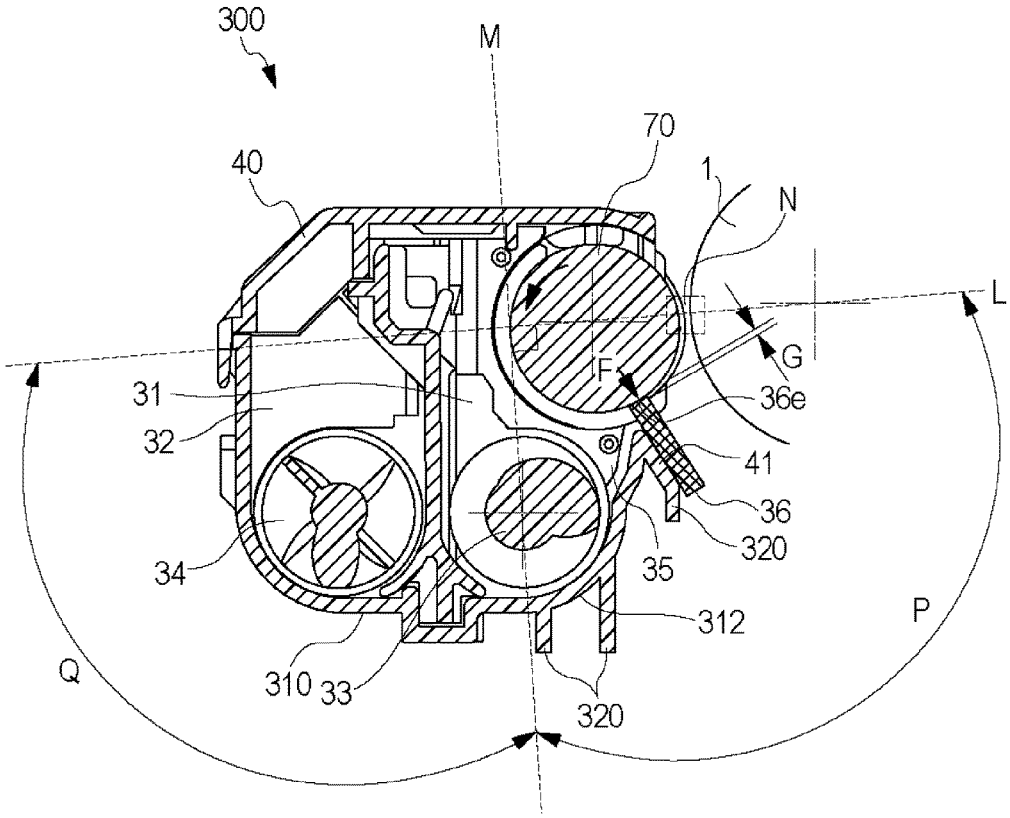
FIG. 13 is a sectional view showing the structure of the developing device according to the First Embodiment.
Figure 14:
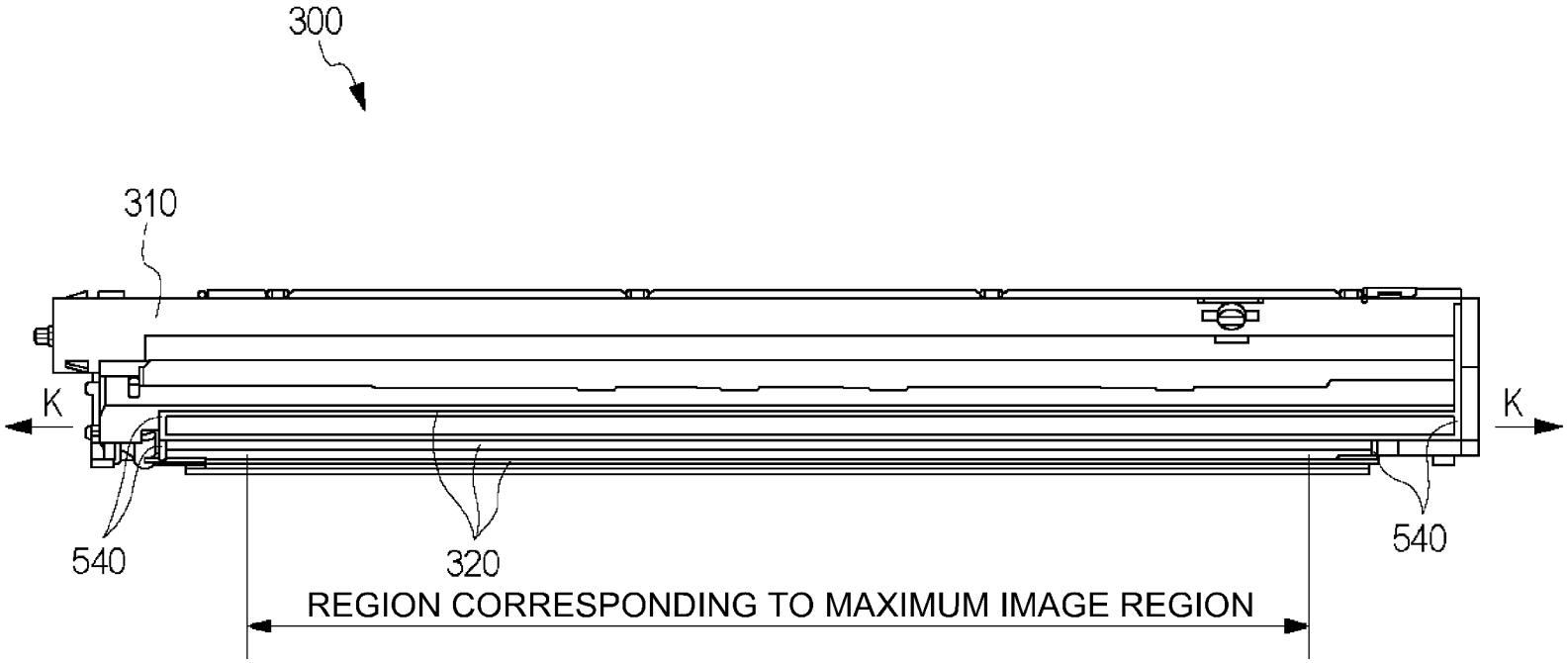
FIG. 14 is a bottom view showing the structure of the developing device according to the First Embodiment.

A structure of the doctor blade according to the First Embodiment will be described using a perspective view of FIG. 12, a sectional view of FIG. 13 and a bottom view of FIG. 14, FIG. 12 shows a maximum image region of a developing device frame 310 of a developing device 300 according to this embodiment. FIG. 13 is the sectional view of the developing device 300 in a cross-section H (the maximum image region of the developing device frame 310) of FIG. 12. FIG. 14 is the bottom view of the developing device 300 mounted in the image forming apparatus 60 as seen from below the developing device 300 with respect to a vertical direction. In each of figures FIGS. 12, 13 and 14, constituent elements (portions) represented by the same reference numerals or symbols as those in FIGS. 2, 3 and 4, respectively, have the same structures. In the structure of the developing device 300 (in the structure of the developing device frame 310), a difference from the above-described structure of the developing device 3 (the structure of the developing device frame 30) will be principally described.

As shown in FIG. 13, a load exerted on the free end portion 36*e* of the doctor blade 36 during the image forming operation is represented by a force (developer pressure F) which passes through an opposing portion of the developing sleeve 70 opposing the free end portion 36*e* of the doctor blade 36 and which is exerted on a tangential line of the developing sleeve 70 with respect to a substantially vertical direction. The developer pressure F is exerted when during the image forming operation (developing operation), the amount of the developer passing through the SB gap G and carried on the surface of the developing sleeve 70 is regulated by the doctor blade 36. During the image forming operation, in order to suppress the fluctuation in magnitude of the SB gap G due to application of the developer pressure F to the free end portion 36*e* of the doctor blade 36, there is a need to increase the rigidity of the doctor blade 36 in a state in which the doctor blade 36 is fixed to the developing device frame 310. Specifically, a region in which the rigidity of the developing device frame 310 should be increased for resisting the developer pressure F is the maximum image region of the blade mounting portion 41 in which the doctor blade 36 is fixed.

Therefore, in this embodiment, as shown in FIGS. 12, 13 and 14, a parallel rib 320 is provided on the blade mounting portion 41 over the entire area of the maximum image region of the blade mounting portion 41, whereby the geometrical moment of inertia of the blade mounting portion 41 in the vertical section is increased.

Incidentally, the parallel rib 320 is a rib including a portion which projects from the blade mounting portion 41 and which is continuously formed along a direction parallel to the rotational axis of the developing sleeve 70. However, in order to enhance the present invention of the blade mounting portion 41, the parallel rib 320 has a thickness of 0.7 mm or more. Further, in order to enhance molding strength, the thickness of the parallel rib 320 may preferably be 1.0 mm or more. Further, in order not to make the mold shrinkage rate non-uniform, the magnitude of the thickness of the parallel rib 320 and the magnitude of the thickness of the blade mounting portion 41 of the developing device frame 310 may preferably be made equal to each other.

Thus, in the case where the parallel rib 320 is provided on the blade mounting portion 41 over the entire area of the blade mounting portion 41, with a temperature change during the image forming operation, the parallel rib 320 elongates and shrinks (expands and contracts) along the direction parallel to the rotational axis of the developing sleeve 70. As a result, on the developing device frame 310 to which the doctor blade 36 is fixed, stress (thermal stress) generating depending on a force acting so as to suppress expansion and contraction of the parallel rib 320 along the direction parallel to the rotational axis of the developing sleeve 70 generates. Although by this thermal stress the developing device frame 310 to which the doctor blade 36 is fixed is distorted along the direction parallel to the rotational axis of the developing sleeve 70, a distorting direction of the developing device frame 310 at this time is a direction in which the developing device frame 310 does not contribute the fluctuation in magnitude of the SB gap G. For this reason, the developing device frame 310 and the doctor blade 36 fixed to the blade mounting portion 41 of the developing device frame 310 is merely displaced substantially uniformly in arrow K directions shown in FIG. 14 with the temperature change during the image forming operation.

Incidentally, even when the parallel rib 320 has an angle (but an acute angle) with respect to the rotational axis of the developing sleeve 70, the angle may only be required to be 5° or less. This is because even the resin-made developing device frame 310 provided with such a parallel rib 320 is sufficiently small in degree of contribution to the fluctuation in magnitude of the SB gap G due to the thermal stress generating in the developing device frame 310 with the temperature change during the image forming operation. For this reason, the portion, of the parallel rib 320, projecting from the blade mounting portion 41 is not limited to one continuously formed along the direction parallel to the rotational axis of the developing sleeve 70. Even when a rib including a portion which projects from the blade mounting portion 41 and which is continuously formed along a direction having an angle (but an acute angle) of larger than 0° and 5° or less, the rib is regarded as the parallel rib 320.

As described above, the portion, of parallel rib 320, projecting from the blade mounting portion 41 is continuously formed along the direction parallel to the rotational axis of the developing sleeve 70. Further, in this embodiment, the parallel ribs 320 are provided on the blade mounting portion 41 over the entire area of the maximum image region of the blade mounting portion 41. In the resin-made developing device frame 310 on which the parallel rib 320 is provided over the entire area of the maximum image region of the blade mounting portion 41, compared with a resin-made developing device frame on which parallel rib 320 is provided in a part of the maximum image region of the blade mounting portion 41 with intervals, when the developing device frame 310 is demounted from the metal mold by opening the metal mold after the molding the developing device frame 310 is easily separated smoothly from a recessed portion (cavity). For that reason, after the molding of the resin-made developing device frame 310 provided with the parallel rib 320 over the entire area of the maximum image region of the blade mounting portion 41, a time required for taking out the developing device frame 310 of the metal mold is prevented from being long. Therefore, even when the parallel rib 320 is provided in the maximum image region of the blade mounting portion 41, compared with the case where the parallel rib 320 is not provided in the maximum image region of the blade mounting portion 41, the time required for taking out the developing device frame 310 of the metal mold after the molding does not become long and is not disadvantageous from the viewpoint of the mass-productivity. Incidentally, in a range in which the time required for taking out the developing device frame 310 of the metal mold after the molding does not become long and is not disadvantageous from the viewpoint of the mass-productivity, a region in which the parallel rib 320 is not provided may exist in a part of the maximum image region of the blade mounting portion 41. Therefore, provision of the parallel rib 320 over the entire area of the maximum image region of the blade mounting portion 41 refers to that the following condition is satisfied. That is, the parallel ribs 320 are provided in a region which is not less than 90% of the maximum image region of the blade mounting portion 41 (preferably be not less than 95% of the maximum image region of the blade mounting portion 41 in order to further enhance the geometrical moment of inertia of the blade mounting portion 41 in the vertical section).

In this embodiment described above, a structure in which in a state that the resin-made doctor blade 36 having the low rigidity is fixed to the resin-made developing device frame 310, the parallel ribs 320 are provided on the blade mounting portion 41 over the entire area of the maximum image region of the blade mounting portion 41 was employed. As a result, even when the resin-made doctor blade 36 having the low rigidity is used, in the state that the resin-made doctor blade 36 having the low rigidity is fixed to the resin-made developing device frame 310, by a simple constitution, it is possible to suppress the fluctuation in magnitude of the SB gap G due to the developer pressure during the image forming operation. Further, in the state that the resin-made doctor blade 36 having the low rigidity is fixed to the resin-made developing device frame 310, the fluctuation in magnitude of the SB gap G due to the thermal stress from the ribs provided on the blade mounting portion 41 of the developing device frame 310 can be suppressed.

Further, in this embodiment, as shown in FIG. 13 and FIG. 14, in a region P of the developing device frame 310, parallel ribs 320 are further provided on an outer wall portion 312 of the developing device frame 310 over an entire area of a maximum image region (excluding the maximum image region of the blade mounting portion 41) of the outer wall portion 312 of the developing device frame 310. Incidentally, the maximum image region of the outer wall portion 312 of the developing device frame 310 refers to a region, of the outer wall portion 312 of the developing device frame 310, corresponding to the maximum image region of the image region in which the image is formable on the surface of the photosensitive drum 1, with respect to the direction parallel to the rotational axis of the developing sleeve 70. As a result, the geometrical moment of inertia of the developing device frame 310 in the vertical section in the region P of the developing device frame 310 is further increased, so that rigidity of a periphery of the free end portion 36*e* of the doctor blade 36, a periphery of the developer guiding portion 35 and a portion from the first feeding screw 33 to the developer guiding portion 35 increases. In this manner, in addition to that the parallel rib 320 is provided on the blade mounting portion 41 over the entire area of the maximum image region of the blade mounting portion 41, the parallel ribs 320 are provided on the outer wall portion 312 of the developing device frame 310 over the entire area of the maximum image region of the outer wall portion 312 in the region P of the developing device frame 310. By providing such a rib structure, the fluctuation in magnitude of the SB gap G due to the developer pressure F can be further suppressed and therefore the provision of the rib structure is advantageous.

Here, definition of the region P and a region Q of the developing device frame 310 shown in FIG. 13 will be described. When the developing device 300 is seen in a cross-section perpendicular to the rotational axis of the developing sleeve 70, the developing device frame 310 is divided into a plurality of regions by a rectilinear line L passing through a rotation center of the developing sleeve 70 and a closest position N and a perpendicular line to the rectilinear line L and passing through a rotation center of the first feeding screw 33. Incidentally, the closest position N is a position where the developing sleeve 70 is closest to the photosensitive drum 1. That is, as shown in FIG. 13, the rectilinear line L is a rectilinear line passing through the rotation center of the developing sleeve 70 and a rotation center of the photosensitive drum 1. In this case, of the plurality of divided regions of the developing device frame 310, the divided region where the blade mounting portion 41 is disposed is the region P of the developing device frame 310. In other words, the region P of the developing device frame 310 is a region occupying a range from 0 degrees to 90 degrees on a side upstream of the closest position N with respect to the rotational direction of the developing sleeve 70. Further, in this case, of the plurality of divided region of the developing device frame 310, the divided region where the blade mounting portion 41 is not disposed is the region Q of the developing device frame 310. In other words, the region Q of the developing device frame 310 is a region occupying a range from 90 degrees to 180 degrees on the side upstream of the closest position N with respect to the rotational direction of the developing sleeve 70.

Second Embodiment

Figure 15:
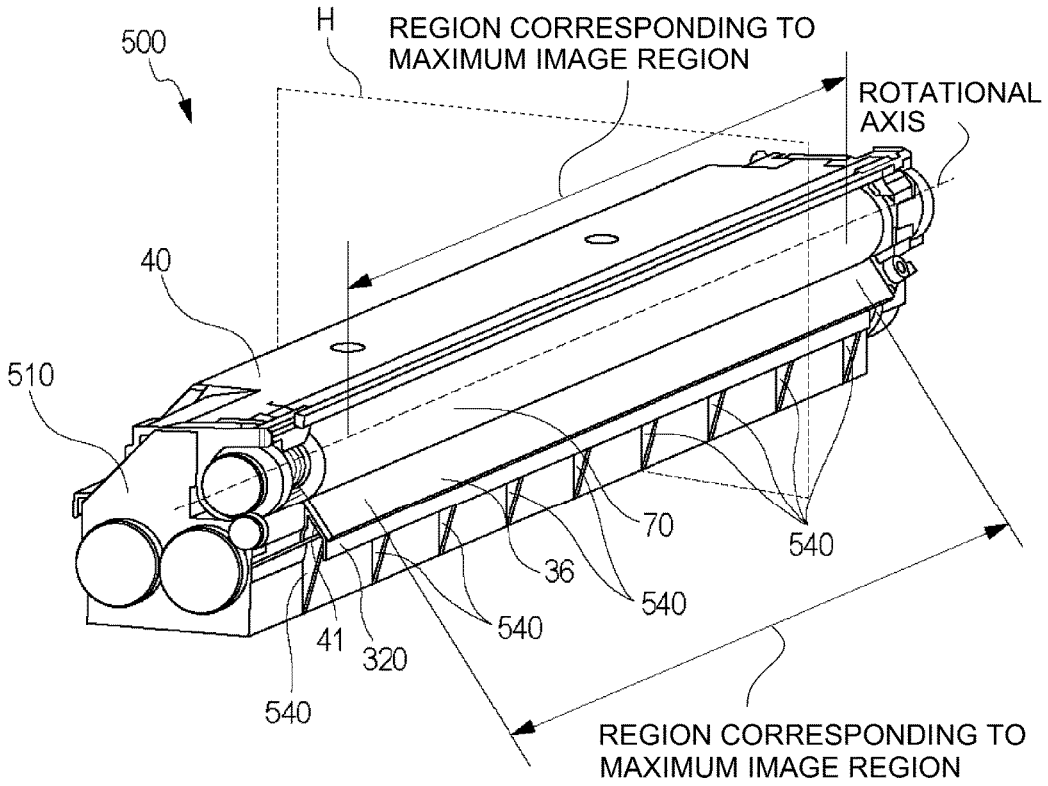
FIG. 15 is a perspective view showing a structure of a developing device according to a Second Embodiment.
Figure 16:
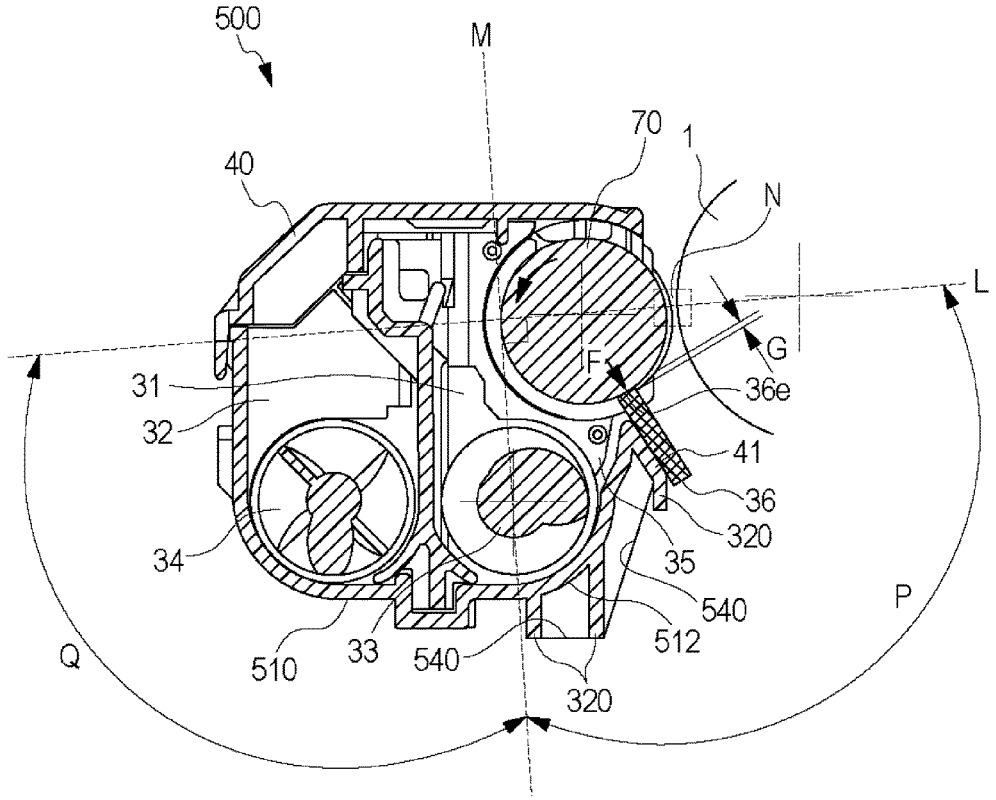
FIG. 16 is a sectional view showing the structure of the developing device according to the Second Embodiment.
Figure 17:
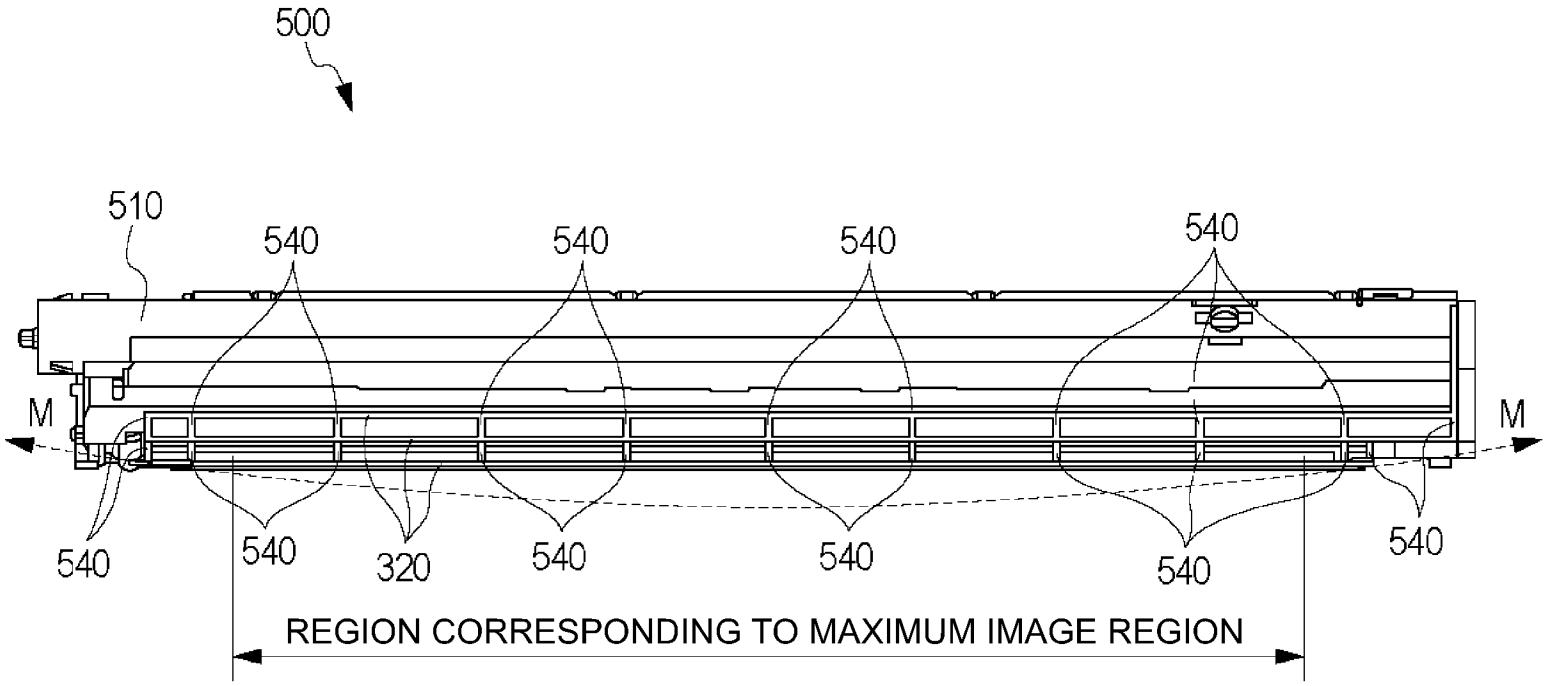
FIG. 17 is a bottom view showing the structure of the developing device according to the Second Embodiment.

Then, a structure of the doctor blade according to a Second Embodiment will be described using a perspective view of FIG. 15, a sectional view of FIG. 16 and a bottom view of FIG. 17. FIG. 15 shows a maximum image region of a developing device frame 510 of a developing device 500 according to this embodiment. FIG. 16 is the sectional view of the developing device 500 in a cross-section H (the maximum image region of the developing device frame 510) of FIG. 15. FIG. 17 is the bottom view of the developing device 500 mounted in the image forming apparatus 60 as seen from below the developing device 500 with respect to a vertical direction. In each of figures FIGS. 15, 16 and 17, constituent elements (portions) represented by the same reference numerals or symbols as those in FIGS. 12, 13 and 14, respectively, have the same structures. A region P shown in FIG. 16 shows the same region as the region P shown in FIG. 13. Further, a region Q shown in FIG. 16 shows the same region as the region Q shown in FIG. 13. In the structure of the developing device 500 (in the structure of the developing device frame 510) in this embodiment, a difference from the structure of the developing device 300 (the structure of the developing device frame 310) described above using FIGS. 12, 13 and 14 will be principally described.

In this embodiment (in the structure of the developing device frame 510) shown in FIGS. 16 and 17, a parallel rib 320 is provided on the blade mounting portion 41 over the entire area of the maximum image region of the blade mounting portion 41 similarly as in the structure of the developing device frame 310 shown in FIGS. 13 and 14. Further, in this embodiment (in the structure of the developing device frame 510) shown in FIGS. 16 and 17, parallel ribs 320 are provided on an outer wall portion 512 of the developing device frame 510 over the entire area of the maximum image region of the outer wall portion 512 in the region P of the developing device frame 510 similarly as in the structure of the developing device frame 310 shown in FIGS. 13 and 14.

On the other hand, in this embodiment (in the structure of the developing device frame 510) shown in FIGS. 16 and 17, different from the structure of the developing device frame 310 shown in FIGS. 13 and 14, crossing ribs 540 are provided in a part of the maximum image region of the blade mounting portion 41. However, in order to enhance the present invention of the blade mounting portion 41, each of the crossing ribs 540 has a thickness of 0.7 mm or more. Further, in order to enhance molding strength, the thickness of the crossing ribs 540 may preferably be 1.0 mm or more. Further, in order not to make the mold shrinkage rate non-uniform, the magnitude of the thickness of the crossing rib 540 and the magnitude of the thickness of the blade mounting portion 41 of the developing device frame 510 may preferably be made equal to each other.

Incidentally, each of the crossing ribs 540 includes a portion projecting from the blade mounting portion 41 is continuously formed along the direction crossing the rotational axis of the developing sleeve 70. Specifically, the portion, of each of the crossing ribs 540, projecting from the blade mounting portion 41 is continuously formed along a direction with an angle (but an acute angle) which is larger than 5° and less than 90° with respect to the rotational axis of the developing sleeve 70. Further, even when the portion projecting from the blade mounting portion 41 is continuously formed along a direction crossing the rotational axis of the developing sleeve 70 at right angles, the resultant rib is regarded as the crossing rib 540.

Thus, in the case where the crossing ribs 540 are provided in the part of the maximum image region of the blade mounting portion 41, compared with the case where the crossing ribs 540 are not provided in the part of the maximum image region of the blade mounting portion 41, the rigidity of the blade mounting portion 41 can be further enhanced. However, in the case where the crossing ribs 540 are provided in the part of the maximum image region of the blade mounting portion 41, with a temperature change (temperature rise, temperature lowering) due to heat generating during the image forming operation, the crossing ribs 540 elongate and shrink (expand and contract) along the direction crossing the rotational axis of the developing sleeve 70. As a result, in the developing device frame 510 on which the doctor blade 36 is fixed, thermal stress generates along the direction crossing the rotational axis of the developing sleeve 70. By this thermal stress, the developing device frame 510 on which the doctor blade 36 is fixed is distorted along the direction crossing the rotational axis of the developing sleeve 70, and a distorting direction of the developing device frame 510 at this time is a direction of contribution to the fluctuation in magnitude of the SB gap G.

Particularly, in the case where a portion connecting the parallel rib 320 and the crossing rib 540 exists on the blade mounting portion 41, with the temperature change during the image forming operation, the crossing rib 540 expands and contracts along the direction crossing the rotational axis of the developing sleeve 70. At that time, also the parallel rib 320 connected with the crossing rib 540 is likely to expand and contract together with the crossing rib 540. On the other hand, the parallel rib 320 alone is likely to expand and contract along the direction parallel to the rotational axis of the developing sleeve 70.

Therefore, the crossing rib 540 connected with the parallel rib 320 is constrained by the parallel rib 320 even when the crossing rib 540 is likely to elongate and shrink (expand and contract) by a predetermined amount with the temperature change during the image forming operation. That is, the parallel rib 320 connecting with the crossing rib 540 causes an external force to act on the crossing rib 540 so as to suppress the expansion and contraction of the crossing rib 540, due to the heat, along the direction crossing the rotational axis of the developing sleeve 70, with the result that an internal force generates in the crossing rib 540. For this reason, in the developing device frame 510 including the blade mounting portion 41 where a portion connecting the parallel rib 320 and the crossing rib 540 exists, corresponding to the portion connecting the parallel rib 320 and the crossing rib 540, a place where thermal stress generates along the direction crossing the rotational axis of the developing sleeve 70 generates. As a result, the thermal stresses generating in the developing device frame 510 and the doctor blade 36 fixed to the blade mounting portion 41 of the developing device frame 510 are liable to cause a local difference (level difference of a thermal stress difference) therebetween.

Accordingly, with the temperature change due to the heat generating during the image forming operation, there is a liability that curvature deformation generates in the doctor blade 36 with respect to an arrow M direction shown in FIG. 17 and thus the doctor blade 36 flexes at a longitudinal central portion thereof. For this reason, in the Second Embodiment in which the crossing ribs 540 are provided on the blade mounting portion 41 in a part of the maximum image region of the blade mounting portion 41, although the rigidity can be further enhanced, there is a liability that the amount of fluctuation in magnitude of the SB gap G with the temperature change during the image forming operation becomes large. Therefore, as regards the suppression of the fluctuation in magnitude of the SB gap G with the temperature change during the image forming operation. The First Embodiment in which the crossing ribs 540 are not provided over the entire area of the maximum image region of the blade mounting portion 41 is preferable to the Second Embodiment. The reason therefor will be described below.

In the First Embodiment, as shown in FIGS. 13 and 14, on the blade mounting portion 41, the crossing ribs 540 are not provided over the entire area of the maximum image region of the blade mounting portion 41. For this reason, in the maximum image region of the blade mounting portion 41 to which the doctor blade 36 is fixed, the thermal stress along the direction crossing the rotational axis of the developing sleeve 70 does not generate. Further, on the blade mounting portion 41, the crossing ribs 540 are not provided over the entire area of the maximum image region of the blade mounting portion 41, and therefore, also a portion where the parallel rib 320 and the crossing rib 540 connect with each other does not exist. For this reason, the level difference of the thermal stress distribution does not generate between the developing device frame 310 and the doctor blade 36 fixed to the blade mounting portion 41 of the developing device frame 310. Therefore, with the temperature change due to the heat generating during the image forming operation, the developing device frame 310 and the doctor blade 36 fixed to the blade mounting portion 41 of the developing device frame 310 are only displaced substantially uniformly in the arrow K directions shown in FIG. 14. As a result, even when the resin-made doctor blade 36 having the low rigidity is used, it is possible to suppress the fluctuation in magnitude of the SB gap G with the temperature change during the image forming operation in the state in which the doctor blade 36 is fixed on the resin-made developing device frame 310.

However, as long as the following condition is satisfied, on the blade mounting portion 41, the crossing ribs 540 may also be provided in a part of the maximum image region of the blade mounting portion 41. That is, even in the case where the crossing ribs 540 are provided on the blade mounting portion 41 in the part of the maximum image region of the blade mounting portion 41, during the image forming operation, the SB gap G falls within a predetermined range over the direction parallel to the rotational axis of the developing sleeve 70. For example, in the case where the magnitude of the SB gap G is set at about 300 μm, and allowance of the fluctuation amount of the SB gap G with the temperature change during the image forming operation is set at ±20 μm or less, for example. In such a case, as long as the fluctuation amount of the SB gap G with the temperature change during the image forming operation is ±20 μm or less, the SB gap G with the temperature change during the image forming operation is regarded as being within the predetermined range.

Further, in the resin-made developing device frame 510 such that the crossing ribs 540 are provided on the blade mounting portion 41 in the part of the maximum image region of the blade mounting portion 41, when the developing device frame 510 is taken out of the metal mold, the developing device frame 510 is not readily separated smoothly from a recessed portion (cavity) of the metal mold. Particularly, with an increasing number of the crossing ribs 540 provided on the blade mounting portion 41, when the developing device frame 510 is taken out of the metal mold, a degree that the developing device frame 510 is not readily separated smoothly from the recessed portion (cavity) of the metal mold becomes large. Therefore, also from the viewpoint of mass-productivity such that a time for taking out the developing device frame of the metal mold after the molding is shortened, the First Embodiment in which the crossing ribs 540 are not provided on the blade mounting portion 41 in the part of the maximum image region of the blade mounting portion 41 is preferable to the Second Embodiment.

Incidentally, as shown in FIGS. 13 and 14, the crossing ribs 540 may also be provided on the blade mounting portion 41 in non-image forming regions of the blade mounting portion 41. Incidentally, the non-image forming regions of the blade mounting portion 41 refer to regions, with respect to the direction parallel to the rotational axis of the developing sleeve 70, of the blade mounting portion 41 corresponding to a region in which the image is unable to be formed on the surface of the photosensitive drum 1. This is because the crossing ribs 540 provided on the blade mounting portion 41 in the non-image forming regions of the blade mounting portion 41 contribute to reinforcement of the rigidity of the developing device frame 310. On the other hand, the crossing ribs 540 provided on the blade mounting portion 41 in the non-image forming regions of the blade mounting portion 41 cause no curvature deformation of the doctor blade 36 with a heat cycle of heating/cooling. The reason therefor will be described below.

In the case where the crossing ribs 540 are provided on the blade mounting portion 41 in the non-image forming regions of the blade mounting portion 41, with the temperature change during the image forming operation, the crossing ribs 540 provided on the blade mounting portion 41 in the non-image forming regions of the blade mounting portion 41 expand and contract in the direction crossing the rotational axis of the developing sleeve 70. As a result, in the developing device frame 310 to which the doctor blade 36 is fixed, the thermal stress generates along the direction crossing the rotational axis of the developing sleeve 70. On the other hand, as shown in FIGS. 13 and 14, the crossing ribs 540 are provided on the blade mounting portion 41 within the non-image forming regions of the blade mounting portion 41, not within the maximum image region of the blade mounting portion 41.

In the non-image forming regions of the developing device frame 310, the sleeve supporting portions 42 of the developing device frame 310 are provided. Incidentally, the non-image forming portions of the developing device frame 310 refer to regions, with respect to the direction parallel to the rotational axis of the developing sleeve 70, of the developing device frame 310 corresponding to the region in which the image is unable to be formed on the surface of the photosensitive drum 1. For that reason, the geometrical moment of inertia of the developing device frame 310 in the vertical section in each of the non-image forming regions of the developing device frame 310 is larger than the geometrical moment of inertia of the developing device frame 310 in the vertical section in the maximum image region of the developing device frame 310. Therefore, the developing device frame 310 has the rigidity higher in the non-image forming regions than in the maximum image region. For this reason, by providing the crossing ribs 540 on the blade mounting portion 41 in the non-image forming regions, even when the thermal stress generates in the developing device frame 310 having the high rigidity in the non-image forming regions, a degree of contribution of the crossing ribs 540 to distortion of the developing device frame 310 in the direction crossing the rotational axis of the developing sleeve 70 is sufficiently small. In other words, even when the crossing ribs 540 are provided on the blade mounting portion 41 in the non-image forming regions, a degree of contribution to the fluctuation in magnitude of the SB gap G is sufficiently small.

Further, as shown in FIG. 16 and FIG. 17, in a region P of the developing device frame 510, the crossing ribs 540 may also be provided on an outer wall portion 512 of the developing device frame 510 over an entire area of a maximum image region (excluding the maximum image region of the blade mounting portion 41) of the outer wall portion 512 of the developing device frame 510. Incidentally, the maximum image region of the outer wall portion 512 of the developing device frame 510 refers to a region, of the outer wall portion 512 of the developing device frame 510, corresponding to the maximum image region of the image region in which the image is formable on the surface of the photosensitive drum 1, with respect to the direction parallel to the rotational axis of the developing sleeve 70. This is because in the region P of the developing device frame 510, the crossing ribs 540 provided on the outer wall portion 512 of the developing device frame 510 in the maximum image region of the outer wall portion 512 contribute to the reinforcement of the rigidity of the developing device frame 510. On the other hand, in the region P of the developing device frame 510, the crossing ribs 540 provided on the outer wall portion 512 of the developing device frame 510 in the maximum image region of the outer wall portion 512 do not cause the curvature deformation of the doctor blade 36 with the heat cycle of heating/cooling. The reason therefor will be described below.

In the case where in the region P of the developing device frame 510, the crossing ribs 540 are provided on the outer wall portion 512 of the developing device frame 510 in the maximum image region of the outer wall portion 512, with the temperature change during the image forming operation, the crossing ribs 540 provided on the outer wall portion 512 in the maximum image region of the outer wall portion 512 expand and contract in the direction crossing the rotational axis of the developing sleeve 70. As a result, in the developing device frame 510 to which the doctor blade 36 is fixed, the thermal stress generates along the direction crossing the rotational axis of the developing sleeve 70. On the other hand, the geometrical moment of inertia of the developing device frame 510 in the vertical section in the region P is larger than the geometrical moment of inertia of the doctor blade 36 in the vertical section.

For that reason, as shown in FIGS. 16 and 17, in the region P of the developing device frame 510, the crossing ribs 540 may only be required to be provided on the outer wall portion 512 of the developing device frame 510 in the maximum image region of the outer wall portion 512. This is because the rigidity of the developing device frame 510 in the region P is predominant over the thermal stress generating along the direction crossing the rotational axis of the developing sleeve 70. Therefore, in the region P, by providing the crossing ribs 540 on the outer wall portion 512 of the developing device frame 510 in the region P, even when the thermal stress generates in the developing device frame 510 having the high rigidity in the region P, a degree of contribution of the crossing ribs 540 to distortion of the developing device frame 510 in the direction crossing the rotational axis of the developing sleeve 70 is sufficiently small. In other words, in the region P of the developing device frame 510, even when the crossing ribs 540 are provided on the outer wall portion 512 of the developing device frame 510, a degree of contribution to the fluctuation in magnitude of the SB gap G is sufficiently small.

Other Embodiments

The present invention is not limited to the above-described embodiments, and various modifications (including organic combinations of the respective embodiments) can be made on the basis of the intent of the present invention and are not excluded from the scope of the present invention.

In the above-described embodiments, as shown in FIG. 1, the image forming apparatus 60 having a constitution in which the intermediary transfer belt 61 is used as the image bearing member was described as an example, but the present invention is not limited thereto. The present invention is also applicable to an image forming apparatus having a constitution in which transfer of the image is carried out by causing a recording material to directly contact the photosensitive drum 1 successively. In that case, the photosensitive drum 1 constitutes a rotatable image bearing member for carrying the toner image.

Figure 2:
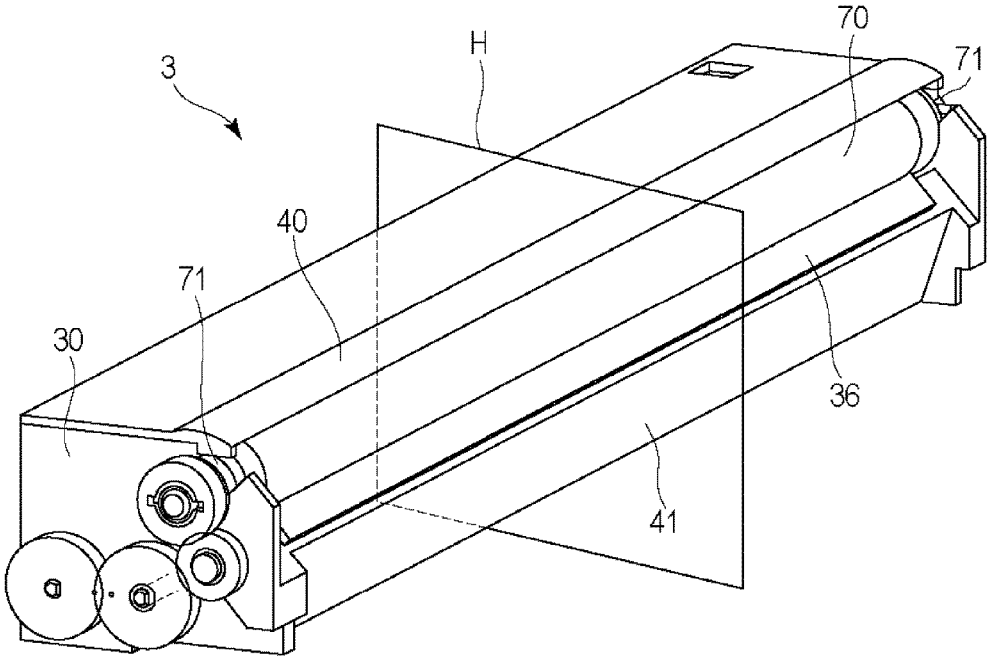
FIG. 2 is a perspective view showing a structure of a developing device.

Further, in the above-described embodiments, as shown in FIG. 2, the developing device 3 (developing device 300) having a constitution in which the developing sleeve 70 is rotated in the counterclockwise direction and in which the doctor blade 36 is disposed below the developing sleeve 70 was described as an example, but the present invention is not limited thereto. The present invention is also applicable to a developing device 300 having a constitution in which the developing sleeve 70 is rotated in the clockwise direction and in which the doctor blade 36 is disposed above the developing sleeve 70.

Further, in the above-described embodiments, as shown in FIG. 2, the developing device 3 (developing device 300) having a constitution in which the developing chamber 31 and the stirring chamber 32 are arranged laterally with respect to the horizontal direction was described as an example, but the present invention is not limited thereto. The present invention is also applicable to a developing device 300 having a constitution in which the developing chamber 31 and the stirring chamber 32 are arranged vertically with respect to a direction of gravitation.

Further, in the above-described embodiments, the developing device 300 was described as a single unit, but a similar effect can be obtained even in the form of a process cartridge which is prepared by integrally assembling the image forming portion 600 (FIG. 1) including the developing device 300 into a unit and which is detachably mountable to the image forming apparatus 60. Further, when the image forming apparatus 60 includes the developing device 300 or the process cartridge, the present invention is applicable irrespective of a monochromatic (image forming) machine and a color (image forming) machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2017-172338 filed on Sep. 7, 2017 and 2018-146713 filed on Aug. 3, 2018, which are hereby incorporated by reference herein in their entirety.

What is claimed is:

1. A developing device comprising:

a rotatable developing member configured to carry and feed a developer toward a position where an electrostatic image formed on an image bearing member is developed;

a resin-made regulating blade provided opposed to said rotatable developing member in non-contact with said rotatable developing member and configured to regulate an amount of the developer carried on said rotatable developing member; and a resin-made developing device frame including a fixing portion configured to fix said regulating blade, said fixing portion being provided over a maximum image region in which an image is formable on the image bearing member, said fixing portion extending along a rotational axis direction of said rotatable developing member, wherein said regulating blade is fixed, in a state that said regulating blade is flexed, over a region of said fixing portion corresponding to the maximum image region in which an image is formable on the image bearing member so that a gap between said rotatable developing member supported by said developing device frame and said regulating blade mounted on said fixing portion falls within a predetermined range over the rotational axis direction of said rotatable developing member, and wherein said fixing portion is provided with a rib projecting from said fixing portion and extending along the rotational axis direction of said rotatable developing member, said rib is formed over a substantial entirety of the region of said fixing portion corresponding to the maximum image region.

2. A developing device according to claim 1, wherein said fixing portion further includes a crossing rib projecting from said fixing portion and extending along a direction crossing the rotational axis direction of said rotatable developing member, said crossing rib is formed outside the region of said fixing portion corresponding to the maximum image region, and said crossing rib is not formed in the region of said fixing portion corresponding to the maximum image region.

3. A developing device according to claim 1, wherein said fixing portion further includes a crossing rib projecting from said fixing portion and extending along a direction crossing the rotational axis direction of said rotatable developing member, said crossing rib is formed in the region of said fixing portion corresponding to a non-image region in which an image is unable to be formed on the image bearing member, and said crossing rib is not formed in the region of said fixing portion corresponding to the maximum image region.

4. A developing device according to claim 1, wherein said regulating blade is fixed, with an adhesive, over an entirety of a region of said fixing portion corresponding to the maximum image region.

5. A developing device according to claim 1, wherein said rib has a thickness of 0.7 mm or more.

6. A developing device according to claim 1, wherein said rib is formed in a region which is not less than 90% of the region of said fixing portion corresponding to the maximum image region.

7. A developing device according to claim 1, wherein said rib is formed in a region which is not less than 95% of the region of said fixing portion corresponding to the maximum image region.

8. A developing device comprising:

a rotatable developing member configured to carry and feed a developer toward a position where an electrostatic image formed on an image bearing member is developed;

a resin-made regulating blade provided opposed to said rotatable developing member in non-contact with said rotatable developing member and configured to regulate an amount of the developer carried on said rotatable developing member; and a resin-made developing device frame including a fixing portion configured to fix said regulating blade, said fixing portion being provided over a maximum image region in which an image is formable on the image bearing member, said fixing portion extending along a rotational axis direction of said rotatable developing member, wherein said fixing portion is provided with a rib projecting from said fixing portion and extending along the rotational axis direction of said rotatable developing member, said rib is formed over a substantial entirety of the region of said fixing portion corresponding to the maximum image region.

9. A developing device according to claim 8, wherein said fixing portion further includes a crossing rib projecting from said fixing portion and extending along a direction crossing the rotational axis direction of said rotatable developing member, said crossing rib is formed outside the region of said fixing portion corresponding to the maximum image region, and said crossing rib is not formed in the region of said fixing portion corresponding to the maximum image region.

10. A developing device according to claim 9, wherein said crossing rib has a thickness of 0.7 mm or more.

11. A developing device according to claim 8, wherein said fixing portion further includes a crossing rib projecting from said fixing portion and extending along a direction crossing the rotational axis direction of said rotatable developing member, said crossing rib is formed in the region of said fixing portion corresponding to a non-image region in which an image is unable to be formed on the image bearing member, and said crossing rib is not formed in the region of said fixing portion corresponding to the maximum image region.

12. A developing device according to claim 11, wherein said crossing rib has a thickness of 0.7 mm or more.

13. A developing device according to claim 8, wherein said rib has a thickness of 0.7 mm or more.

14. A developing device according to claim 13, wherein said rib has a thickness of 1.0 mm or more.

15. A developing device according to claim 8, wherein said regulating blade is fixed, with an adhesive, in the region of said fixing portion corresponding to the maximum image region.

16. A developing device according to claim 8, wherein said regulating blade is fixed over the entirety of the region of said fixing portion corresponding to the maximum image region.

17. A developing device according to claim 8, wherein said regulating blade is fixed, with an adhesive, over the entirety of the region of said fixing portion corresponding to the maximum image region.

18. A developing device according to claim 8, wherein said regulating blade has a rigidity capable of being flexed.

19. A developing device according to claim 8, wherein said rib is formed in a region which is not less than 90% of the region of said fixing portion corresponding to the maximum image region.

20. A developing device according to claim 8, wherein said rib is formed in a region which is not less than 95% of the region of said fixing portion corresponding to the maximum image region.

* * * * *